US012116708B2

(12) United States Patent
Matsushita et al.

(10) Patent No.: US 12,116,708 B2
(45) Date of Patent: Oct. 15, 2024

(54) PRESSER FOOT POSITION RETAINER AND SEWING MACHINE INCLUDING PRESSER FOOT POSITION RETAINER

(71) Applicant: BROTHER KOGYO KABUSHIKI KAISHA, Nagoya (JP)

(72) Inventors: Hironori Matsushita, Nagoya (JP); Nobuhiko Funato, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 33 days.

(21) Appl. No.: 18/189,714

(22) Filed: Mar. 24, 2023

(65) Prior Publication Data

US 2023/0323579 A1 Oct. 12, 2023

(30) Foreign Application Priority Data

Mar. 30, 2022 (JP) ..... 2022-055864

(51) Int. Cl.
*D05B 29/02* (2006.01)
*D05B 29/08* (2006.01)
*D05B 29/12* (2006.01)

(52) U.S. Cl.
CPC ..... *D05B 29/02* (2013.01); *D05B 29/08* (2013.01); *D05B 29/12* (2013.01)

(58) Field of Classification Search
CPC ..... D05B 29/02; D05B 29/08; D05B 29/12
USPC ..... 112/151, 60, 61, 235, 240
See application file for complete search history.

(56) References Cited

U.S. PATENT DOCUMENTS

| | | | | |
|---|---|---|---|---|
| 2,586,936 | A * | 2/1952 | Goldstein | D05B 29/06 112/235 |
| 9,631,306 | B2 * | 4/2017 | Shomura | D05B 29/08 |
| 11,993,881 | B2 * | 5/2024 | Yoshikawa | D05C 11/06 |
| 2012/0097085 | A1 * | 4/2012 | Fukao | D05B 29/12 112/240 |
| 2015/0167217 | A1 * | 6/2015 | Yokoyama | D05B 29/06 112/151 |
| 2019/0112738 | A1 * | 4/2019 | Iwasaki | D05B 83/00 |
| 2023/0313429 | A1 * | 10/2023 | Mori | D05B 29/12 112/240 |

FOREIGN PATENT DOCUMENTS

JP S54-131447 A 10/1979

* cited by examiner

*Primary Examiner* — Tajash D Patel
(74) *Attorney, Agent, or Firm* — Oliff PLC

(57) ABSTRACT

A presser foot position retainer includes a presser foot and a restricting member. The presser foot is swingably attachable to a presser holder of a sewing machine. The presser foot includes a shaft extending in an axial direction, a restricted portion, and a pressing surface configured to press a workpiece. The restricting member includes a restricting portion capable of contacting the restricted portion. The restricting member is attachable to the presser holder. The restricting member is configured to move between a first position and a second position by a user operation. When the restricting member is located at the second position, the restricting portion is in contact with the restricted portion to limit a swingable range within which the presser foot attached to the presser holder is swingable about the shaft to less than that when the restricting member is located at the first position.

20 Claims, 18 Drawing Sheets

PRESSER FOOT POSITION RETAINER AND SEWING MACHINE INCLUDING PRESSER FOOT POSITION RETAINER

REFERENCE TO RELATED APPLICATIONS

This application claims priority from Japanese Patent Application No. 2022-055864 filed on Mar. 30, 2022. The entire content of the priority application is incorporated herein by reference.

BACKGROUND ART

A known presser foot position retainer includes a holder, a presser foot, a pin, and a spring. The holder is fixed to a presser bar of a sewing machine. The holder has a hole into which the pin is to be inserted. The presser foot is rotatably supported by a lower end of the holder. The presser foot has a hole through which the pin passes. The pin passes through the hole of the presser foot and supported by the presser foot. In a state where the pin is engaged with the hole of the holder, in a case where only a portion of a pressing surface of the presser foot is in contact with a workpiece, more specifically, for example, for sewing a workpiece from one of edges thereof, the pin receives an upward force from the presser foot and thus is held in a locked state by the holder and the presser foot. In a case where the pin is in the locked state, the presser foot is restricted from swinging with respect to the presser bar, and thus, the pressing surface of the presser bar extends parallel to a needle plate of the sewing machine. In a case where the entire pressing surface of the presser foot is in contact with the workpiece, for example, for sewing a portion of the workpiece having a uniform thickness, the pin is free from the upward force from the presser foot, and thus, the pin is not in the locked state. In this state, the pin is not in engagement with the hole of the holder due to an urging force of the spring, thereby allowing the presser foot to swing with respect to the presser bar.

DESCRIPTION

In the known presser foot position retainer, for example, in a case where the entire pressing surface of the presser foot contacts the workpiece, the pin is not in engagement with the hole of the holder due to the urging force of the spring, and thus, the pin might not be held in the locked state.

Aspects of the disclosure provides a presser foot position retainer whose state may be changed by a user operation between a normal state and a restricted state in which a swingable range of the presser foot is less than that in the normal state, and a sewing machine including the presser foot position retainer.

In one aspect of the disclosure, a presser foot position retainer may include a presser foot and a restricting member. The presser foot may be swingably attachable to a presser holder of a sewing machine. The presser foot may include a shaft extending in an axial direction, a restricted portion, and a pressing surface configured to press a workpiece. The restricting member may include a restricting portion capable of contacting the restricted portion. The restricting member may be attachable to the presser holder. The restricting member may be configured to move between a first position and a second position by a user operation. When the restricting member is located at the second position, the restricting portion may be in contact with the restricted portion to limit a swingable range within which the presser foot attached to the presser holder is swingable about the shaft to less than that when the restricting member is located at the first position.

The state of the presser foot position retainer may be changed between a normal state and a restricted state by the user operation for moving the restricting member between the first position and the second position. More specifically, for example, the presser foot position retainer may be in the normal state when the restricting member is located at the first position, and may be in the restricted state when the restricting member is located at the second position. When the presser foot position retainer is in the restricted state, the swingable range of the presser foot may be less than that when the presser foot position retainer is in the normal state. Therefore, the state of the presser foot position retainer may be changed between the normal state and the restricted state by the user operation at a desired timing.

In another aspect of the disclosure, a sewing machine may include the presser foot position retainer according to the one aspect of the disclosure, a needle bar having a lower end to which a needle is attachable, a presser bar extending parallel to the needle bar, and a presser holder. The presser holder may include a restricting member attaching portion and a presser foot attaching portion. The restricting member attaching portion may be attached to a lower end of the presser bar such that at least a portion of the restricting member is located opposite to the needle bar with respect to the presser bar. The restricting member of the presser foot position retainer is attachable to the restricting member attaching portion. The shaft of the presser foot may be detachably engageable with the presser foot attaching portion.

In the sewing machine, the state of the presser foot position retainer may be changed between the normal state and the restricted state by the user operation for moving the restricting member between the first position and the second position. More specifically, for example, the presser foot position retainer may be in the normal state when the restricting member is located at the first position, and may be in the restricted state when the restricting member is located at the second position. When the presser foot position retainer is in the restricted state, the swingable range of the presser foot may be less than that when the presser foot position retainer is in the normal state. Therefore, in the sewing machine, the state of the presser foot position retainer may be changed between the normal state and the restricted state by the user operation at a desired timing.

FIGS. 5A, 5B, 5C, and 5D illustrate a procedure for attaching a restricted member to a pressing plate.

Figure 6A:
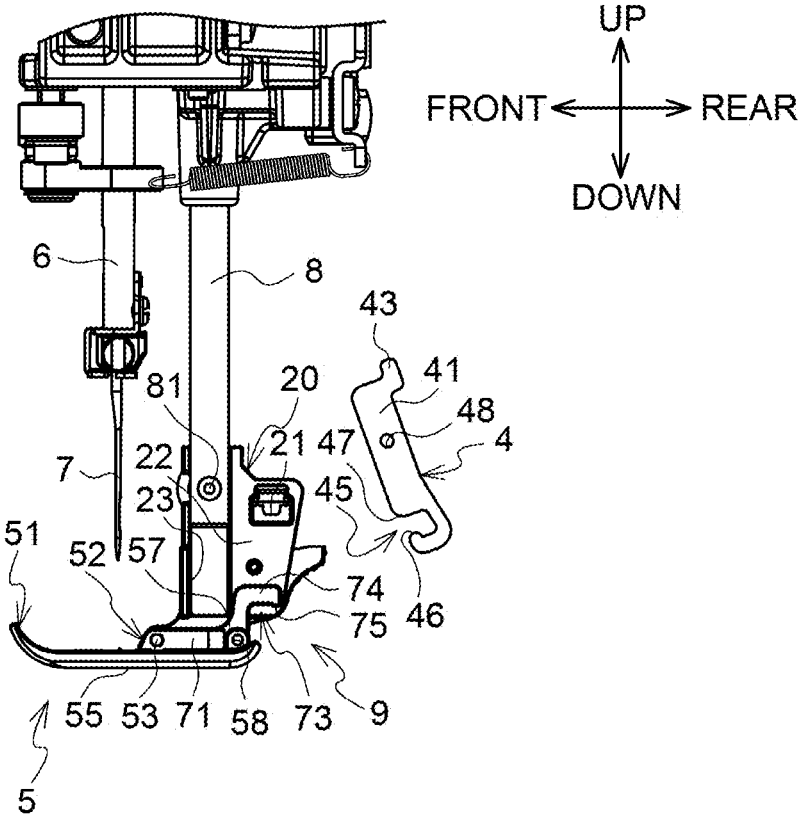
Figure 6B:
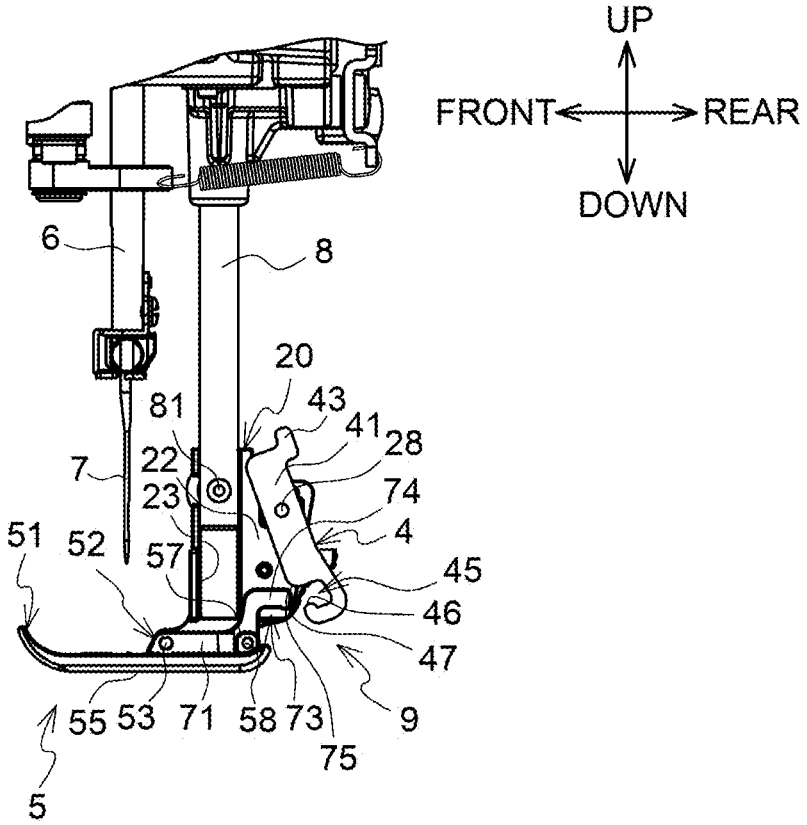

FIGS. 6A and 6B illustrate a procedure for attaching a restricting member to the presser holder.

Figure 7A:
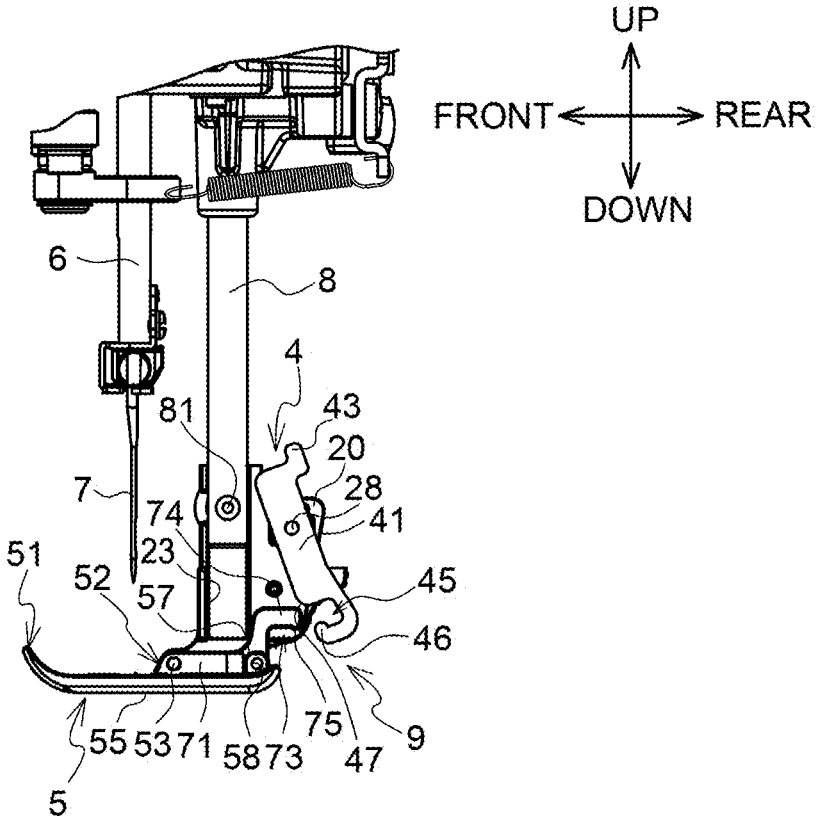

FIG. 7A is a right side view of the presser foot position retainer when the restricting member is located at a first position.

Figure 7B:
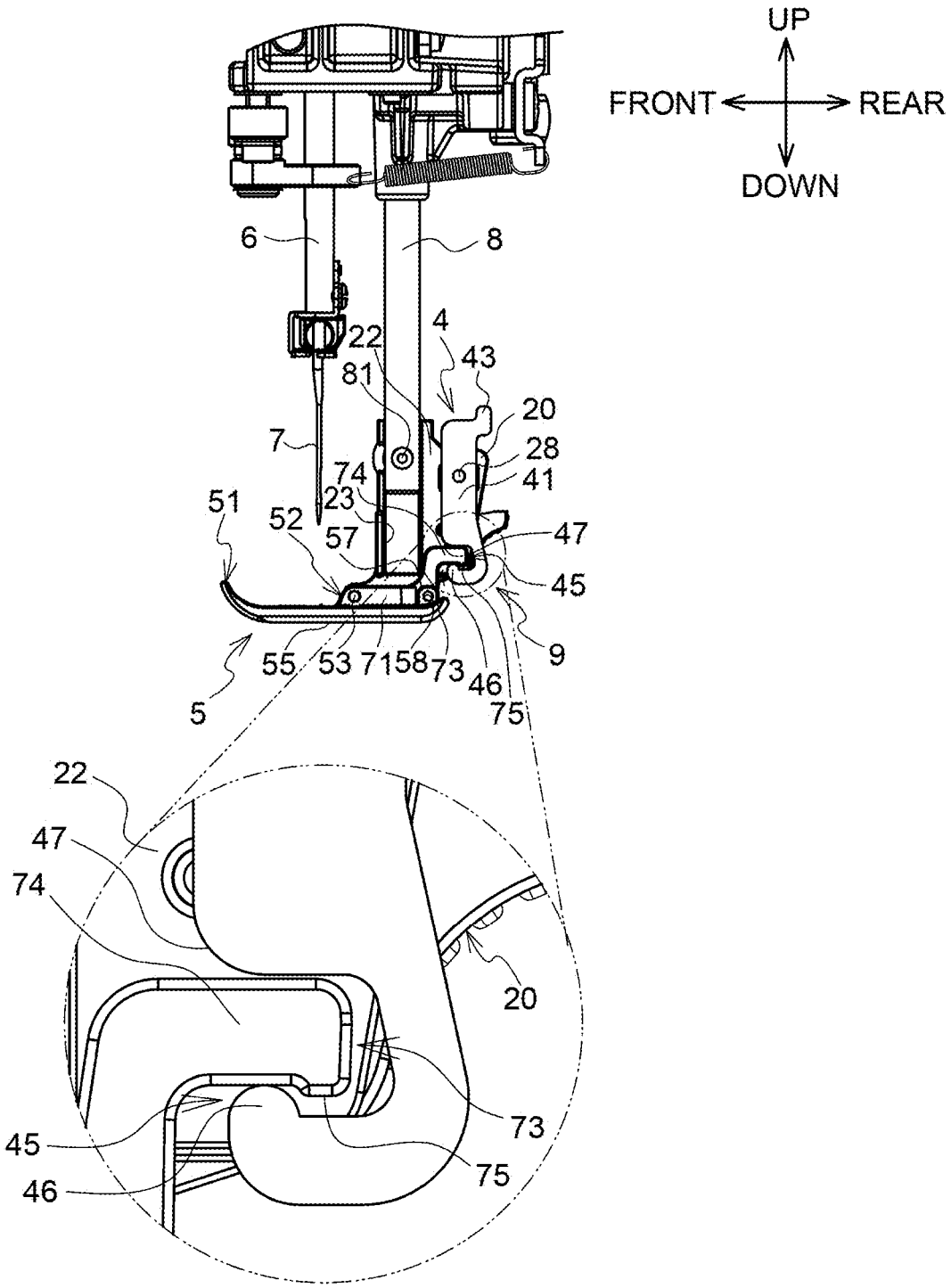

FIG. 7B is a right side view of the presser foot position retainer when the restricting member is located at a second position.

Figure 8A:
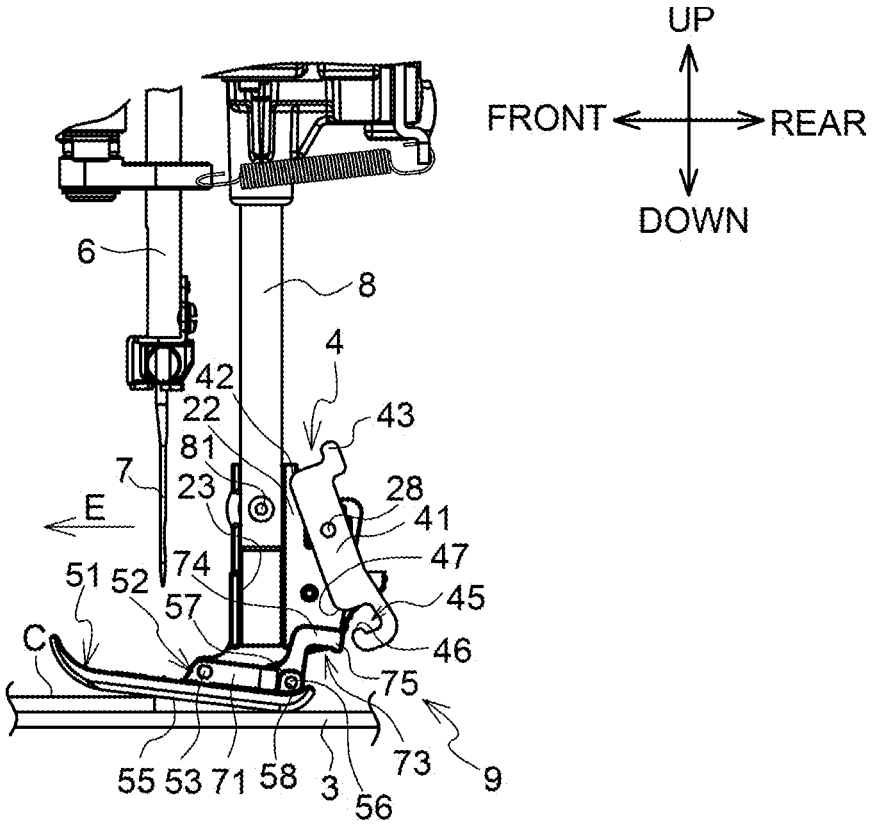

FIG. 8A is a right side view of the presser foot position retainer in a case where a rear edge portion of a workpiece is sewn when the restricting member is located at the first position.

Figure 8B:
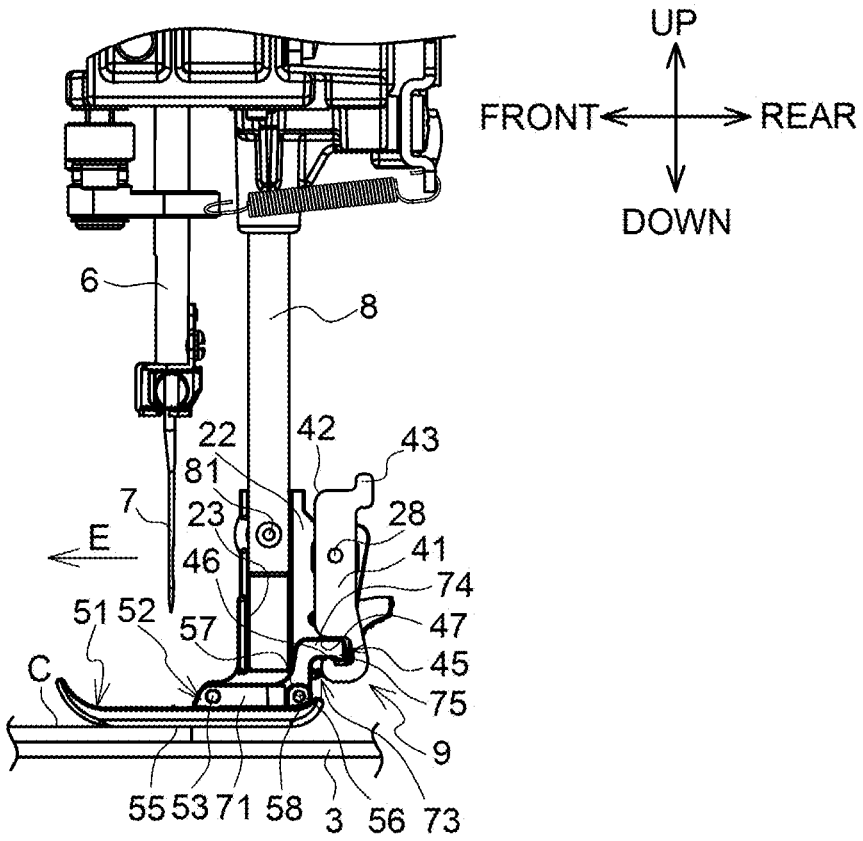

FIG. 8B is a right side view of the presser foot position retainer in a case where the rear edge portion of the workpiece is sewn when the restricting member is located at the second position.

Figure 9A:
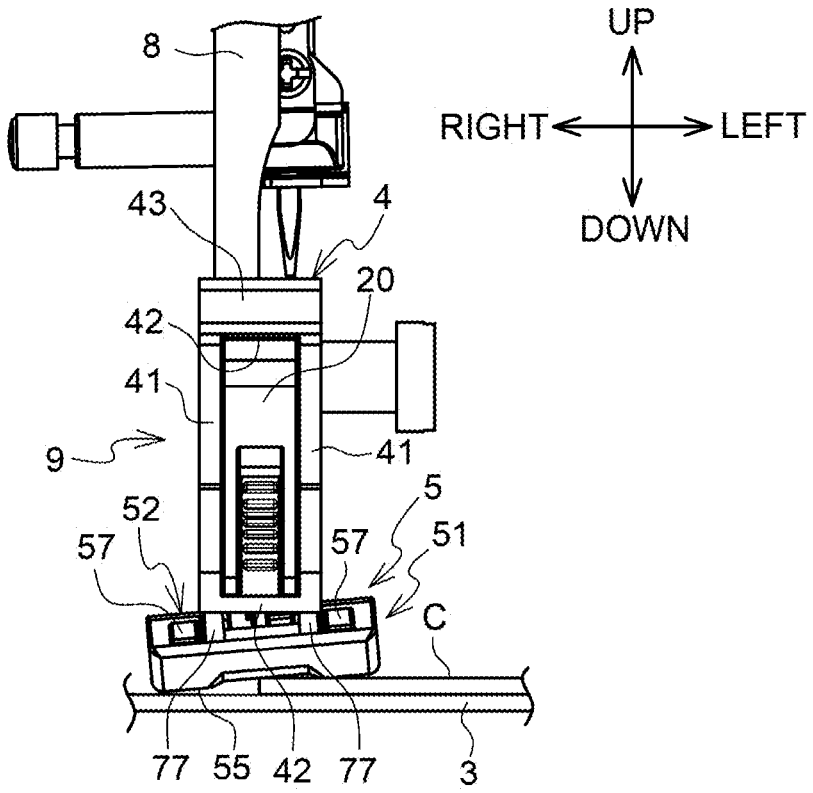

FIG. 9A is a rear view of the presser foot position retainer in a case where a right edge portion of the workpiece is sewn when the restricting member is located at the first position.

Figure 9B:
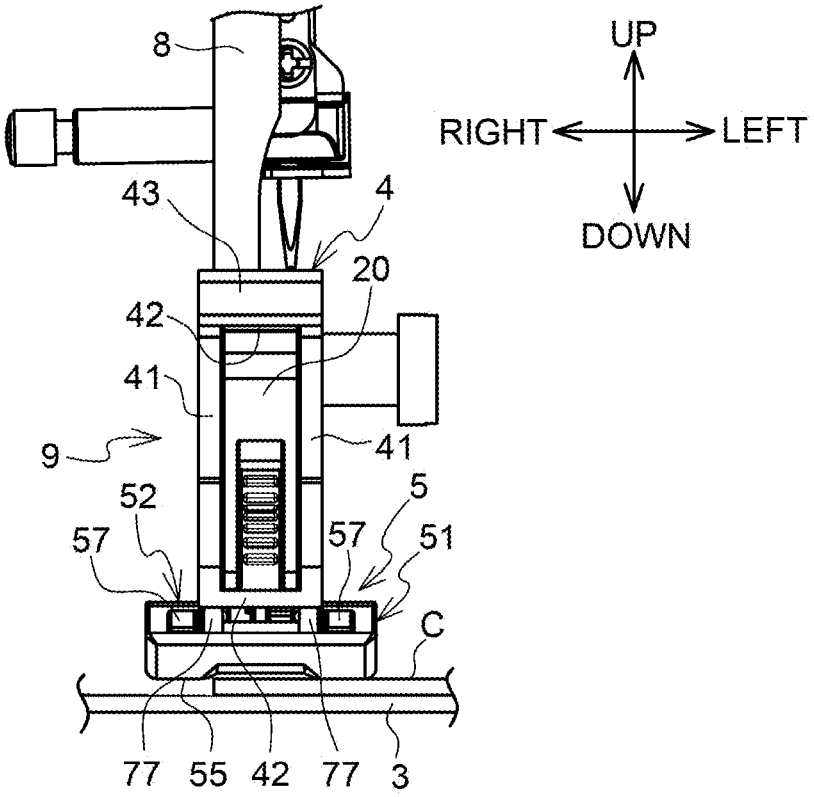

FIG. 9B is a rear view of the presser foot position retainer in a case where the right edge portion of the workpiece is sewn when the restricting member is located at the second position.

Figure 10:
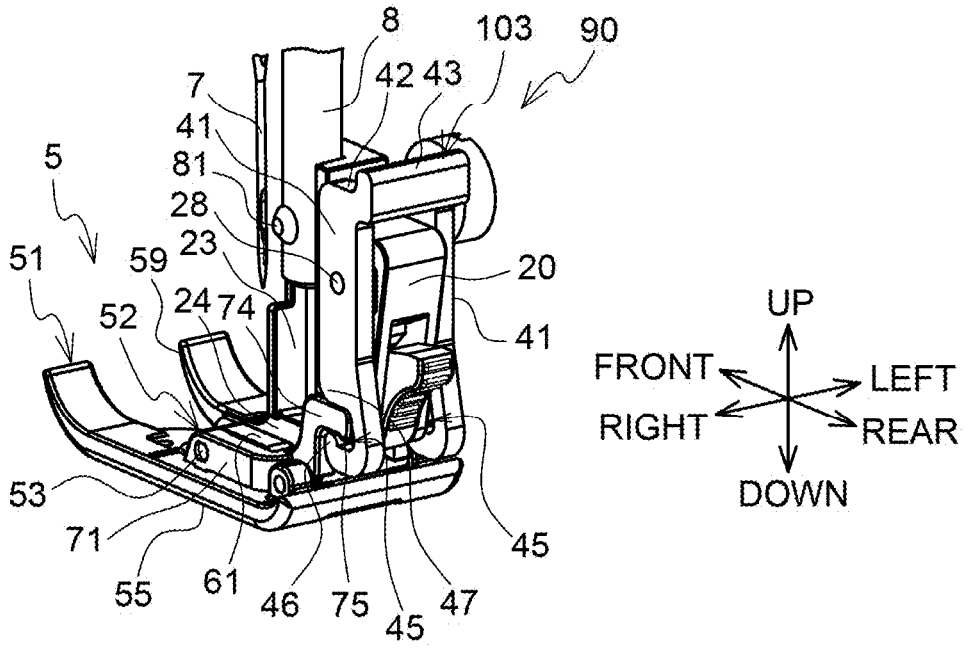

FIG. 10 is a perspective view of another presser foot position retainer according to a first modification, wherein the presser foot position retainer is attached to the lower end portion of the presser bar via the presser holder.

Figure 11:
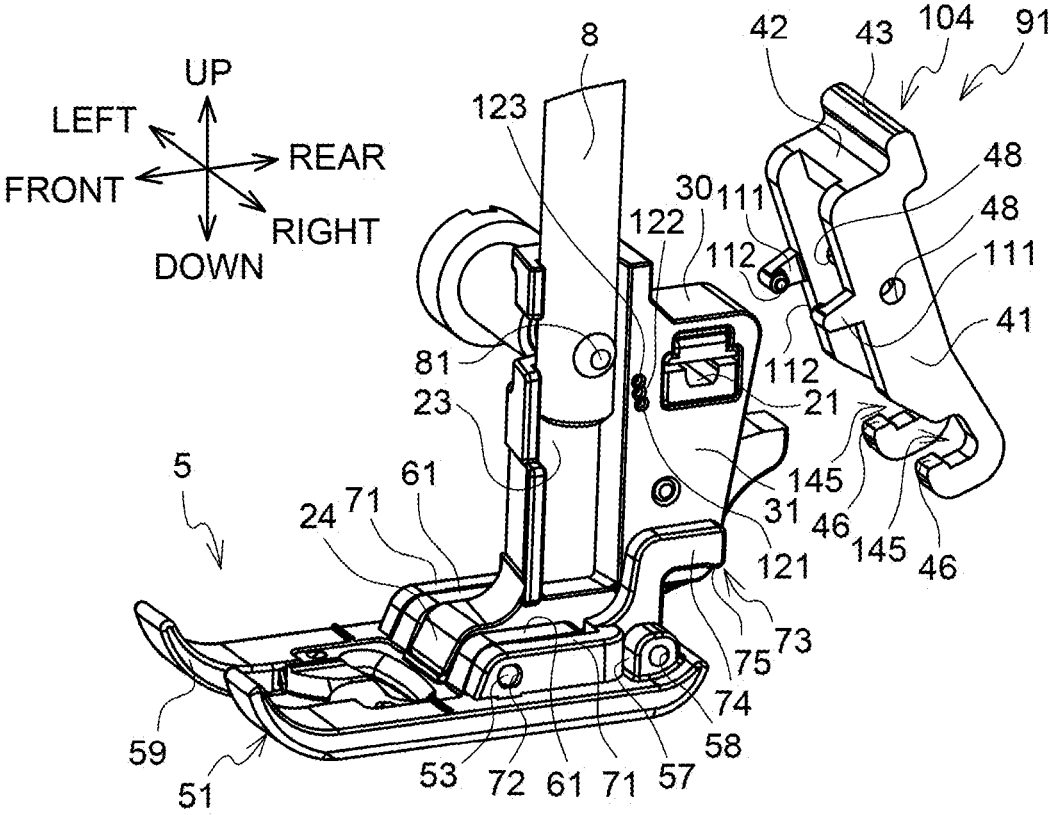

FIG. 11 is a perspective view of another presser foot position retainer according to a second modification, wherein the presser foot is attached to the lower end portion of the presser bar via the presser holder.

Figure 12:
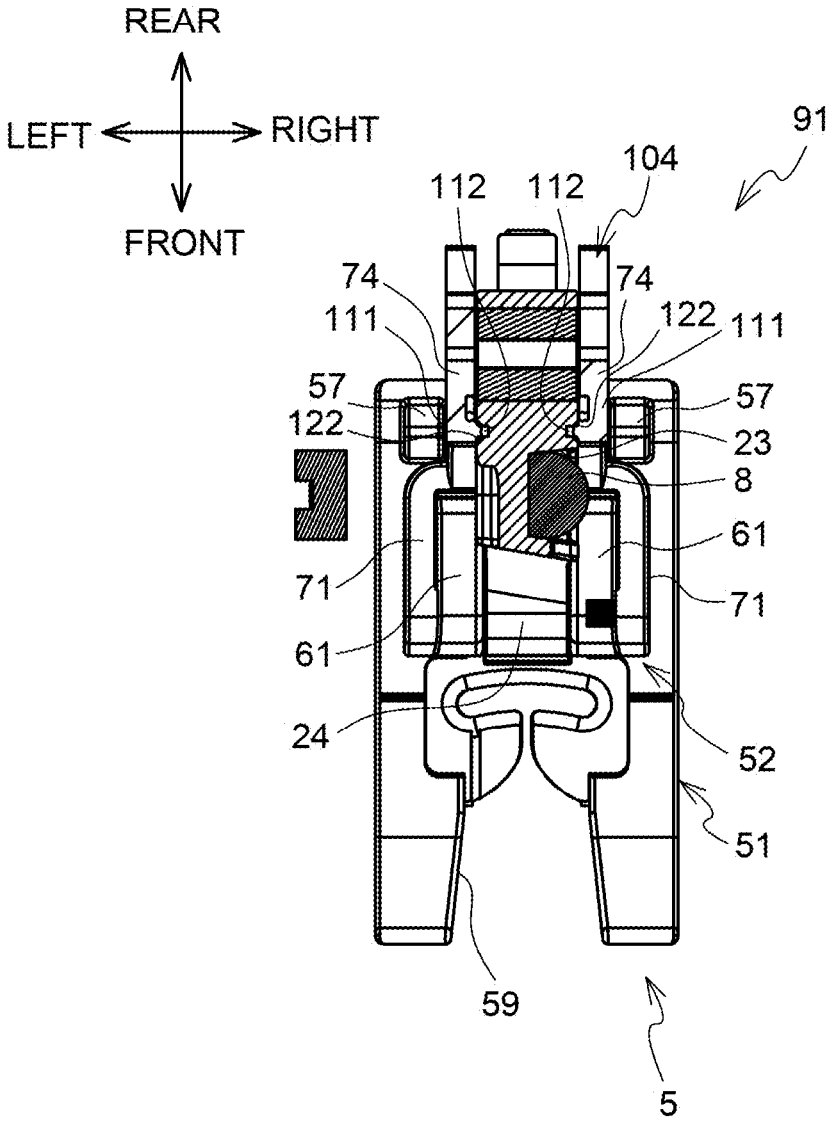
Figure 13A:
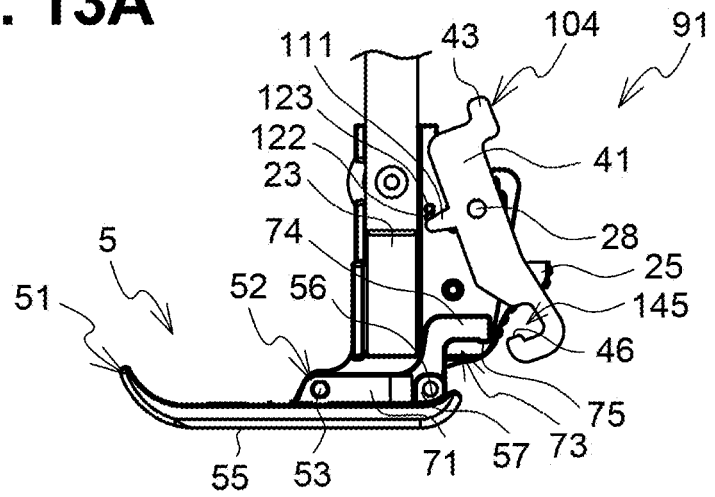
Figure 13B:
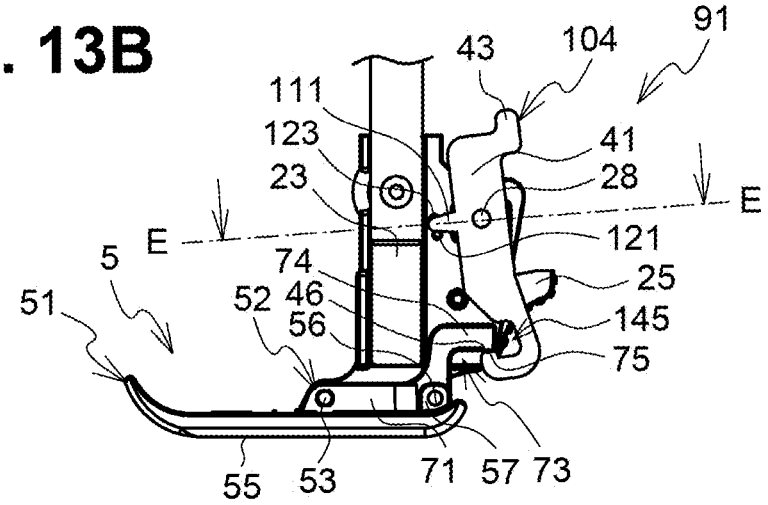

FIG. 12 is a cross-sectional view taken along line E-E in FIG. 13B of the presser foot position retainer according to the second modification attached to the lower end portion of the presser bar via the presser holder.

FIG. 13A is a right side view of the presser foot holding mechanism according to the second modification when the restricting member is located at the first position where an engagement portion of the restricting is in engagement with an engagement portion.

FIG. 13B is a right side view of the presser foot holding mechanism according to the second modification when the restricting member is located at the second position where the engagement portion of the restricting is in engagement with another engagement portion.

Figure 13C:
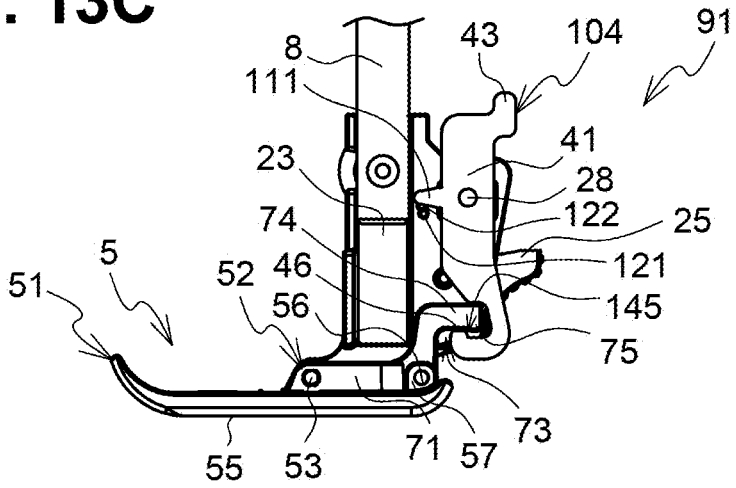

FIG. 13C is a right side view of the presser foot holding mechanism according to the second modification when the restricting member is located at a third position where the engagement portion of the restricting is in engagement with a further engagement portion.

Figure 14:
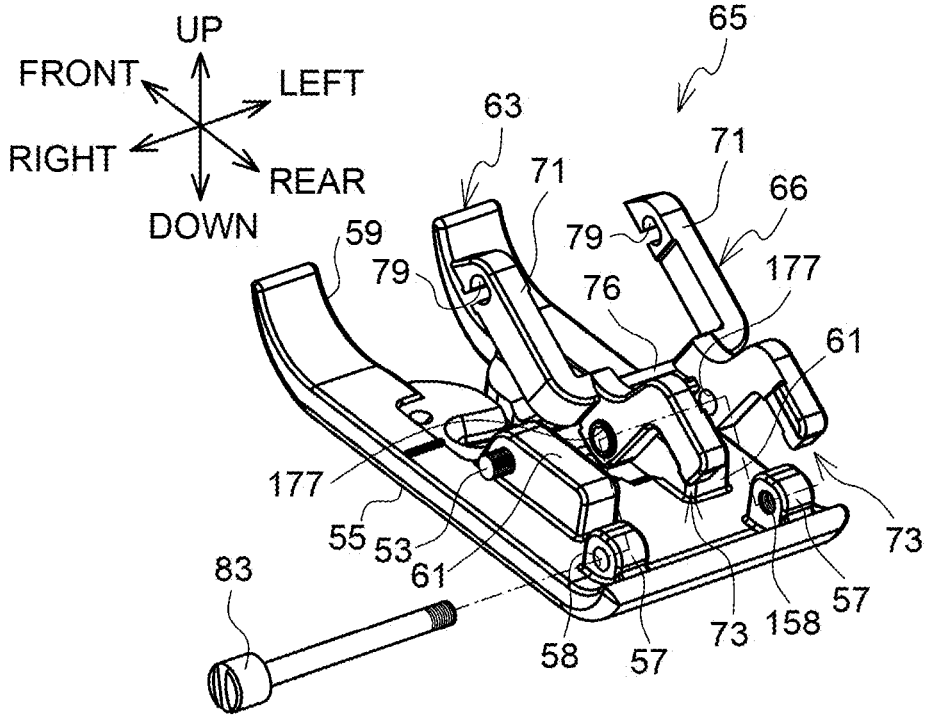

FIG. 14 is a perspective view of another presser foot according to a third modification.

Figure 15:
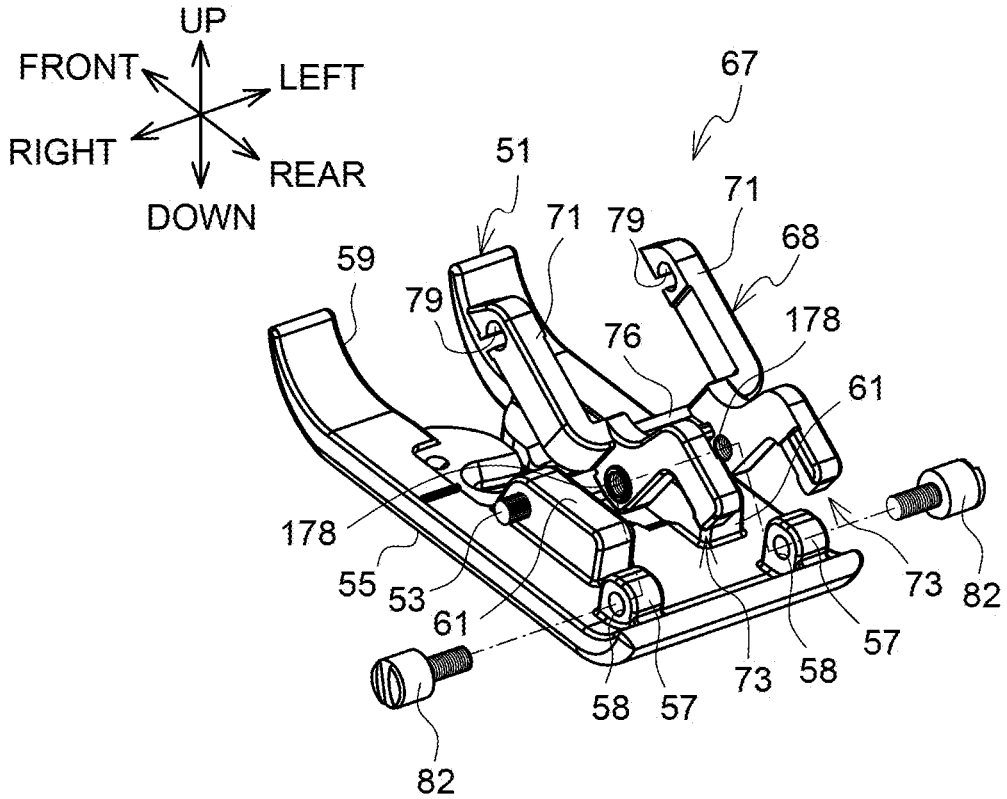

FIG. 15 is a perspective view of another presser foot according to a fourth modification.

Figure 1:
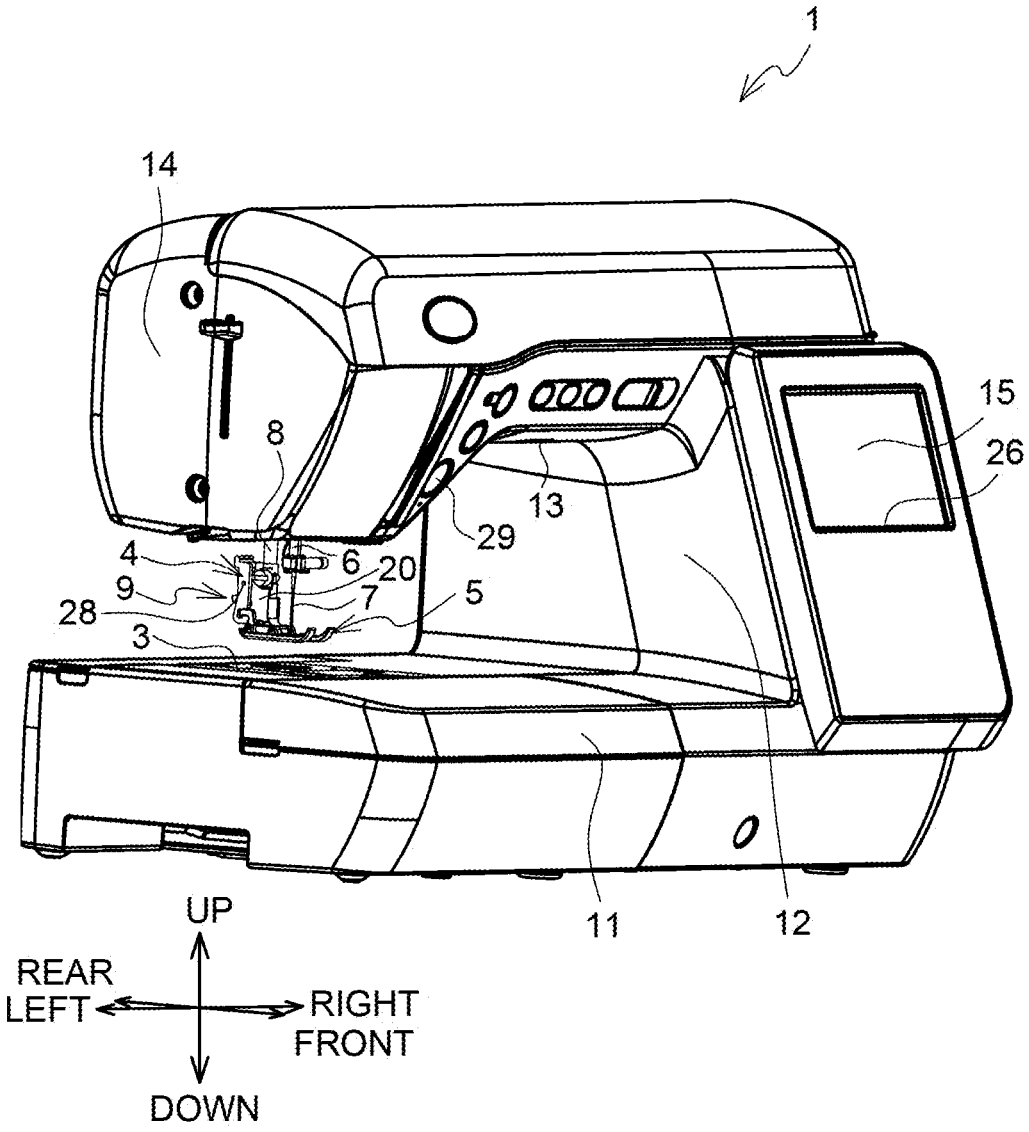
FIG. 1 is a perspective view of a sewing machine to which a presser foot position retainer is attached.

An illustrative embodiment will be described with reference to the accompanying drawings. Referring to FIG. 1, a description will be provided on a configuration of a sewing machine 1 to which a presser foot position retainer 9 is attached. In the page of FIG. 1, an upper side, a lower side, a lower right side, an upper left side, a lower left side, and an upper right side respectively correspond to an upper side, a lower side, a front side, a rear side, a left side, and a right side of the sewing machine 1 to which the presser foot position retainer 9 is attached. As illustrated in FIG. 1, the sewing machine 1 includes a bed 11, an upright arm 12, a horizontal arm 13, and a head 14. A longitudinal direction of the bed 11 and a longitudinal direction of the horizontal arm 13 correspond to a left-right direction of the sewing machine 1. A side of the sewing machine 1 on which the upright arm 12 is disposed is the right side. A direction in which the upright arm 12 is elongated is an up-down direction of the sewing machine 1.

The bed 11 is a base portion of the sewing machine 1, and extends in the left-right direction. The bed 11 includes a needle plate 3 at its upper surface. The bed 11 includes a feed mechanism below the needle plate 3. The feed mechanism is configured to convey a workpiece C (refer to FIG. 8A) toward the rear or front by driving a feed dog. The upright arm 12 extends upward from a right end portion of the bed 11. The upright arm 12 is provided with an LCD 15 at its front surface. The LCD 15 includes a touch screen 26 on its front surface.

The horizontal arm 13 extends leftward from an upper end of the upright arm 12 and faces the bed 11. The head 14 is connected to a left end portion of the horizontal arm 13. Various switches, including a start/stop switch 29, are located at a front surface of the horizontal arm 13 and a front surface of the head 14. The start/stop switch 29 enables a user to provide an instruction to start or stop an operation of the sewing machine 1, for example, to start or stop sewing. The head 14 further includes a needle bar 6, a needle bar mechanism, a swing mechanism, and a presser bar 8. A needle 7 is removably attachable to a lower end of the needle bar 6. The needle bar mechanism is configured to reciprocate the needle bar 6 in the up-down direction. The swing mechanism is configured to swing the needle bar 6 in the left-right direction.

The presser bar 8 is disposed behind the needle bar 6 and extends in the up-down direction. The presser foot position retainer 9 is detachably attachable to a lower end of the presser bar 8 via a presser holder 20. The presser holder 20 includes a presser bar attaching portion 23, a restricting member attaching portion 22, a presser foot attaching portion 24, and a lever 25. The presser bar attaching portion 23 may be a recessed portion defined in a front portion of the presser holder 20. The recessed portion is recessed toward the left. The presser bar attaching portion 23 extends in the up-down direction. The presser holder 20 is detachably attached to the presser bar 8 in a manner that a screw 81 is screwed into a lower end portion of the presser bar 8 positioned at the presser bar attaching portion 23. The restricting member attaching portion 22 may be a rear portion of the presser holder 20. The rear portion of the presser holder 20 is located further to the rear than the presser bar 8. The restricting member attaching portion 22 has a hole 21 (refer to FIG. 6A) extending therethrough in the left-right direction. In the up-down direction, the hole 21 is located higher than the lower end of the presser bar 8. A lower end of the hole 21 is located lower than the center of the screw 81. The presser holder 20 includes a hook-shaped portion in right side view at its front portion. The hook-shaped portion serves as the presser foot attaching portion 24 that is detachably engageable with the shaft 53 of the presser foot 5. The lever 25 is disposed at a rear surface of the presser holder 20 and is accessible by the user. In response to the user operating the lever 25, the presser foot attaching portion 24 is disengaged from the presser foot 5.

Figure 2:
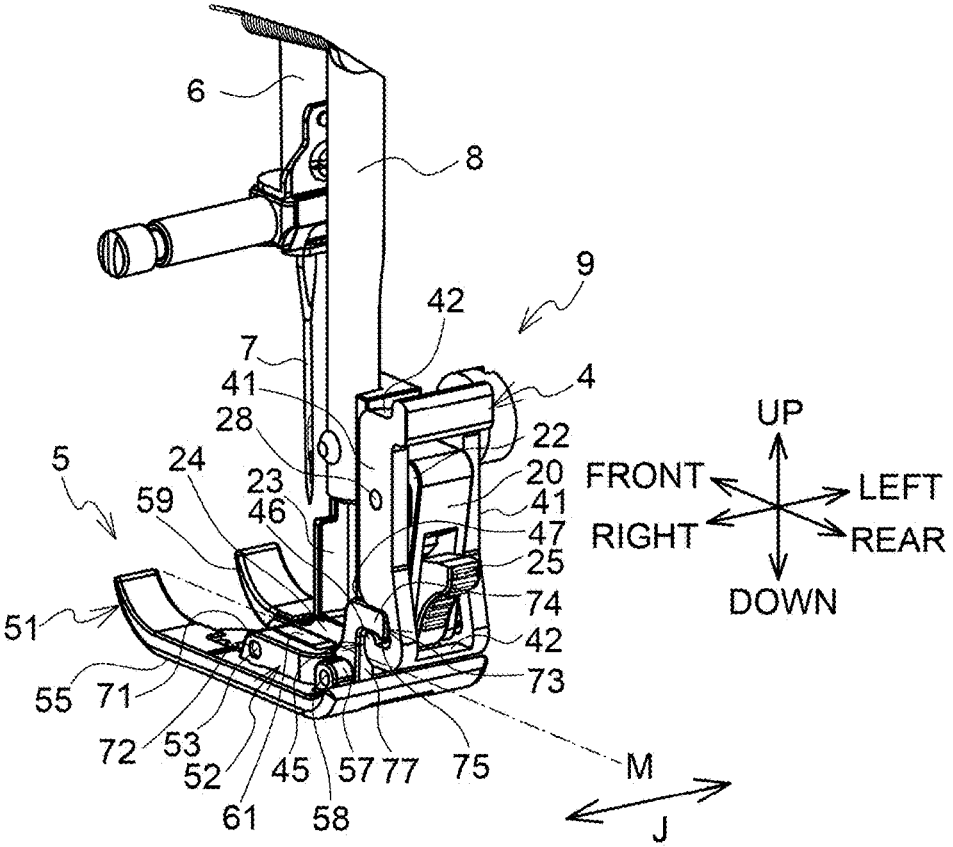
FIG. 2 is a perspective view of the presser foot position retainer attached to a lower end portion of a presser bar via a presser holder.

Referring to FIGS. 1 to 9, a description will be provided on the presser foot position retainer 9 that is attached to the sewing machine 1. As illustrated in FIG. 1, the presser foot position retainer 9 is configured to move a workpiece C in cooperation with the feed dog disposed at the bed 11 while pressing the workpiece C (refer to FIG. 8A) placed on the bed 11 toward an upper surface of the needle plate 3, that is, downward by the presser foot 5. As illustrated in FIG. 2, a center line M extends orthogonal to the left-right direction and passes through the center of the presser foot 5. The presser foot position retainer 9 may have a symmetrical shape with respect to the center line M.

Figure 4:
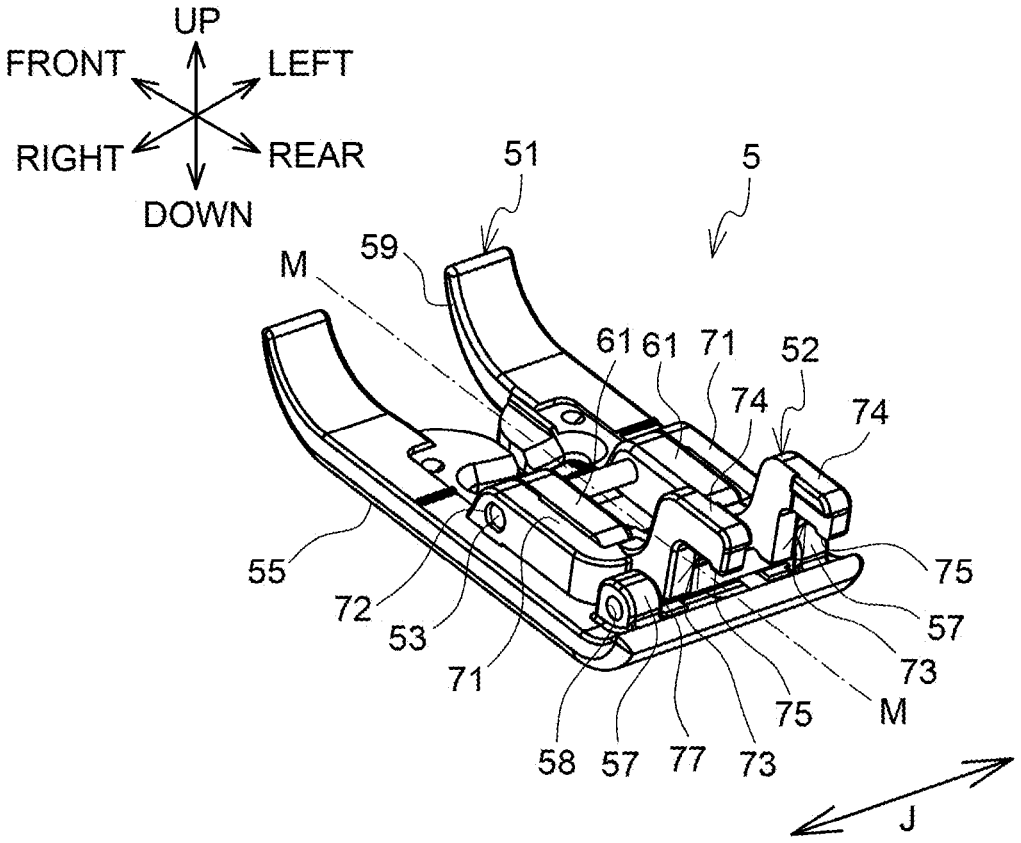
FIG. 4 is a perspective view of a presser foot.

As illustrated in FIG. 2, the presser foot position retainer 9 includes the presser foot 5 and a restricting member 4. The presser foot 5 is swingably attached to the presser foot attaching portion 24 of the presser holder 20 of the sewing machine 1. As illustrated in FIG. 4, the presser foot 5 includes a shaft 53 extending in an axial direction J, a pair of restricted portions 73, and a pressing surface 55 that may press the workpiece C. In the illustrative embodiment, the presser foot 5 includes a pressing plate 51 having the pressing surface 55, and a restricted member 52. The pressing plate 51 has a rectangular plate shape having longer sides extending in the front-rear direction in plan view. The pressing plate 51 has a front end portion and a rear end portion that are curved upward. The pressing surface 55 may be a lower surface of the pressing plate 51. The pressing plate 51 has a particular portion other than the front end portion and the rear end portion. The particular portion of the pressing plate 51 extends horizontally. The pressing plate 51 has a cutout 59. The cutout 59 has a T-shape in plan view. More specifically, the cutout 59 extends from a front end of the pressing plate 51 toward the rear at a middle portion the pressing plate 51 in the left-right direction. In response to the sewing machine 1 being driven in a state where the presser foot position retainer 9 is attached to the lower end of the presser bar 8, the needle 7 passes through a rear end portion of the cutout 59.

The pressing plate 51 includes a pair of left and right shaft support portions 61, a guide 56 (refer to FIG. 5A), and a pair of guide support portions 57. The shaft support portions 61 are disposed behind the cutout 59 and protrude upward from an upper surface of the pressing plate 51. The shaft support portions 61 are spaced apart from each other in the left-right direction and extend in the front-rear direction. The shaft support portions 61 support the shaft 53.

The guide 56 has a rod-like shape and extends parallel to the shaft 53. The pair of guide support portions 57 is disposed behind the pair of shaft support portions 61. The guide support portions 57 are spaced apart from each other in the left-right direction and protrude upward. A distance between the left and right guide support portions 57 in the left-right direction is greater than a distance between the left and right shaft support portions 61 in the left-right direction. Each guide support portion 57 has a hole 58 (only the hole 58 of the left guide support portion 57 is illustrated in FIG. 4) extending therethrough in the left-right direction. The pair of guide support portions 57 supports the guide 56 inserted to the holes 58.

Figure 5A:
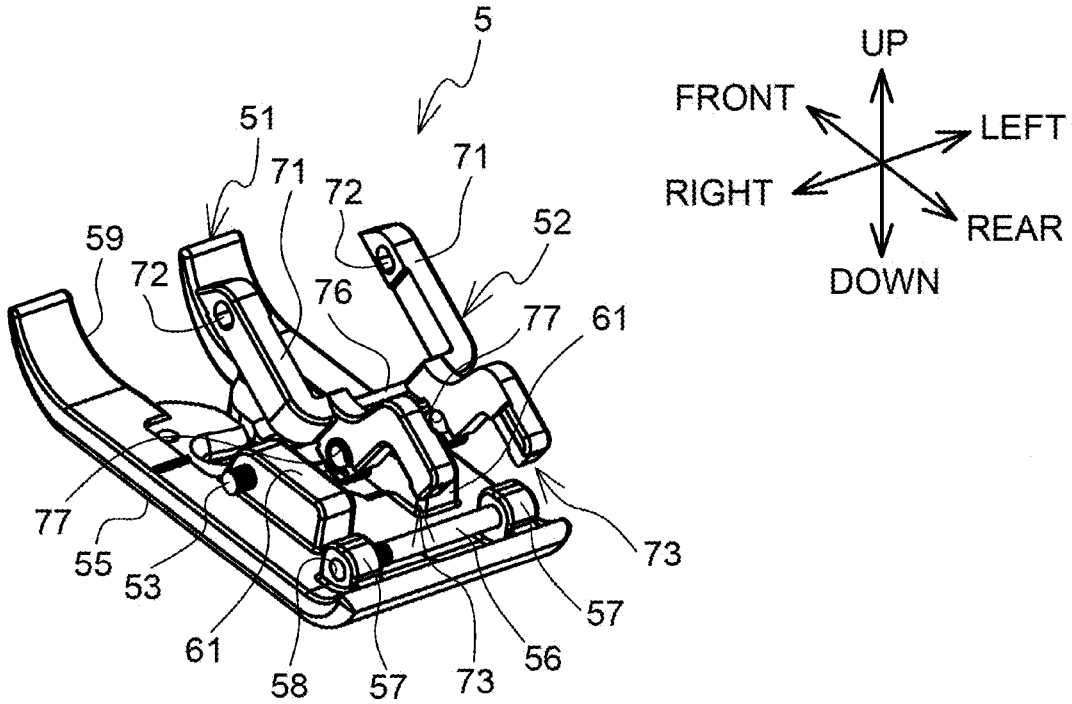
Figure 5B:
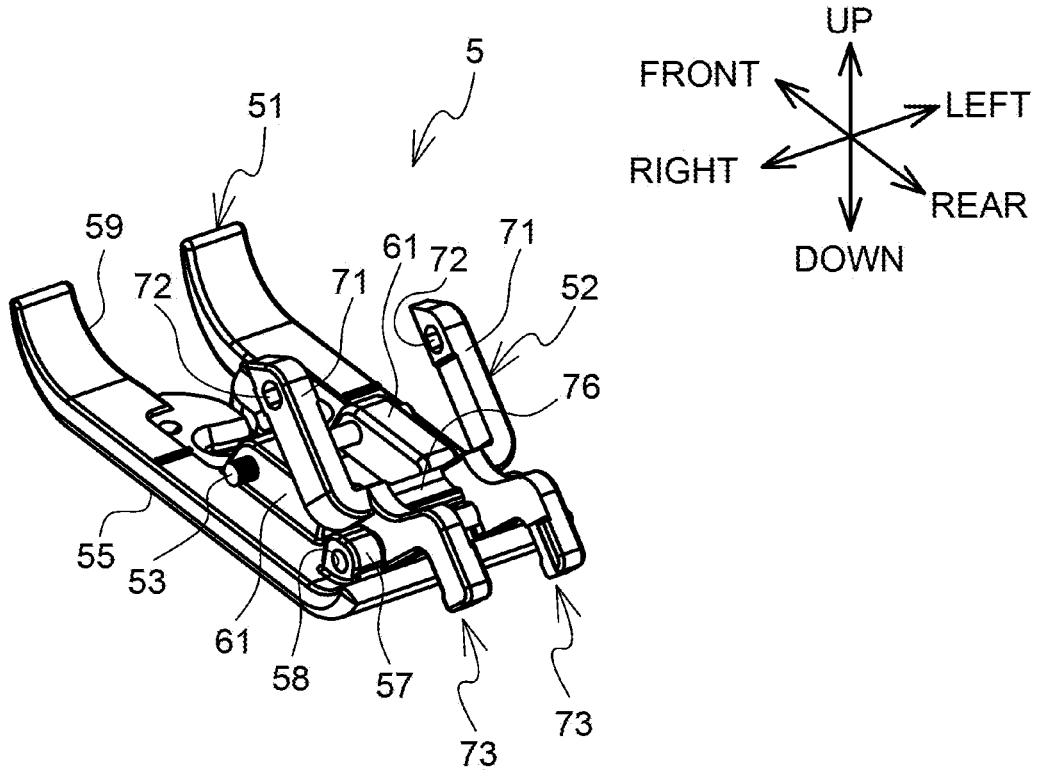
Figure 5C:
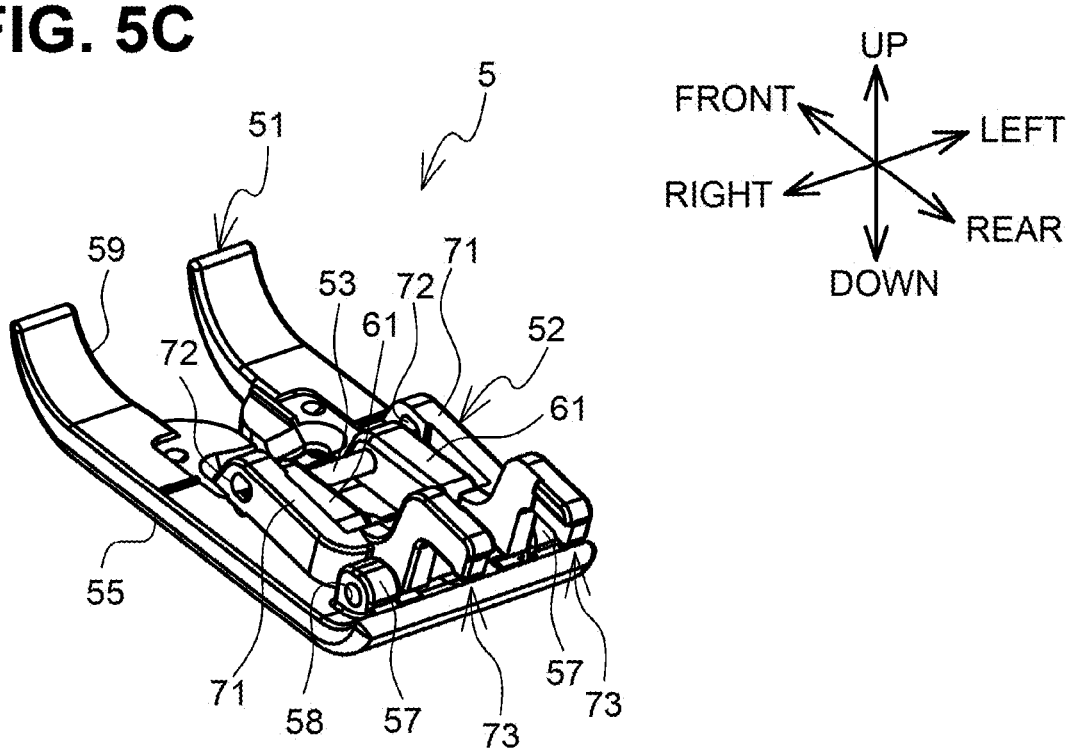

The shaft 53 extends in the axial direction J, that is, in the left-right direction. The presser foot 5 is attached to the presser holder 20 of the sewing machine 1 so as to be swingable about the shaft 53. As illustrated in FIG. 6A, the shaft 53 is disposed between the needle bar 6 and the presser bar 8 in the front-rear direction. The shaft 53 is supported by front end portions of the shaft support portions 61. As illustrated in FIG. 5B, a right end of the shaft 53 is located further to the right than the right shaft support portion 61. A left end of the shaft 53 is located further to the left than the left shaft support portion 61. The shaft 53 has a dimension in the left-right direction shorter than a dimension of the pressing plate 51 in the left-right direction.

The restricted member 52 is detachably attached to the pressing plate 51. In other words, in the illustrative embodiment, the restricted member 52 is separable from the pressing plate 51. In one example, the restricted member 52 may be made of the same material as that used for the pressing plate 51. In another example, the restricted member 52 may be made of a material different from that used for the pressing plate 51. The restricted member 52 may have an H-shape in plan view. As illustrated in FIG. 5A, the restricted member 52 includes a pair of left and right arm portions 71, a pair of left and right restricted portions 73, a connecting portion 76, and a pair of guide engagement portions 77.

The arm portions 71 are spaced apart from each other in the axial direction J, that is, in the left-right direction. The arm portions 71 are disengageably engaged with the shaft 53. Each arm portion 71 has a shaft engagement portion 72. In the illustrative embodiment, the shaft engagement portions 72 may have holes, respectively, that are defined in front end portions of the arm portions 71. The holes extend through the respective arm portion 71 in the left-right direction. The left end of the shaft 53 is inserted into the left shaft engagement portion 72 from the right with respect to the left arm portion 71. The right end of the shaft 53 is inserted into the right shaft engagement portion 72 from the left with respect to the right arm portion 71. As illustrated in FIG. 4, in a state where the restricted member 52 is attached to the pressing plate 51, the ends of the shaft 53 do not protrude from the arm portions 71, respectively.

The restricted portions 73 are disposed further to the rear than the center of the restricted member 52 in the front-rear direction and spaced apart from each other in the axial direction J. As illustrated in FIG. 6A, in a state where the presser foot position retainer 9 is attached to the presser holder 20, the restricted portions 73 are located further to the rear than the presser bar 8. The left restricted portion 73 is located to the left of the restricting member attaching portion 22 of the presser holder 20. The right restricted portion 73 is located to the right of the restricting member attaching portion 22 of the presser holder 20. Each of the restricted portions 73 includes a contact portion 74 and a first protruding portion 75. Each of the contact portions 74 is located above the pressing surface 55 and extends in the front-rear direction parallel to the pressing surface 55. Each of the contact portions 74 has the first protruding portion 75 at its rear end portion. The first protruding portions 75 are located above the pressing surface 55. The first protruding portions 75 extend downward. That is, each restricted portion 73 has a hook-like shape in right view.

The connecting portion 76 connects between rear end portions of the arm portions 71 in the left-right direction. In a state where the restricted member 52 is attached to the pressing plate 51, the connecting portion 76 is located between the pair of shaft support portions 61 and the pair of guide support portions 57 in the front-rear direction.

Figure 5D:
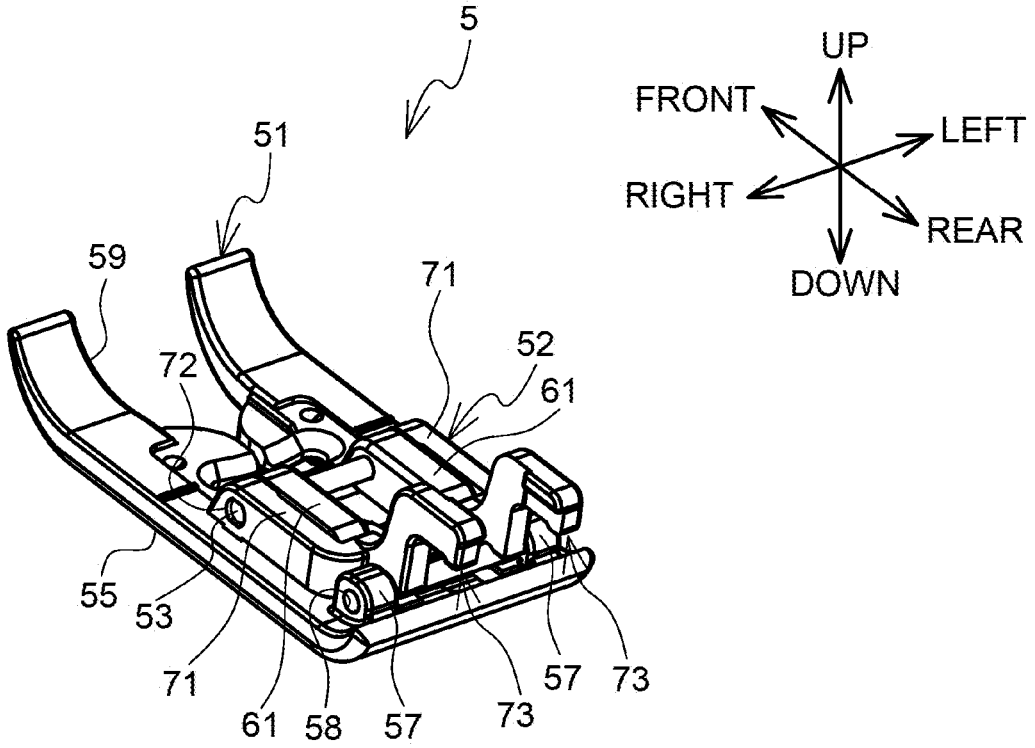

The guide engagement portions 77 may have cutouts having open ends, respectively, opening toward the rear. Engagement of the guide engagement portions 77 with the guide 56 via the cutouts between the guide support portions 57 enables the restricted member 52 to be detachably attached to the pressing plate 51. As illustrated in FIG. 5D, in a state where the restricted member 52 is attached to the pressing plate 51, the left guide engagement portion 77 is located to the right of the left guide support portion 57. In this state, the right guide engagement portion 77 is located to the left of the right guide support portion 57.

For attaching the pressing plate 51 to the restricted member 52, the restricted member 52 is positioned above the pressing plate 51 (refer to FIG. 5A) and then the guide engagement portions 77 are engaged with the guide 56 (refer to FIG. 5B). Next, the restricted member 52 is rotated with respect to the pressing plate 51 about the guide 56. Thereafter, the left arm portion 71 is placed to the left of the left end portion of the shaft 53 and the right arm portion 71 is placed to the right of the right end portion of the shaft 53 (refer to FIG. 5C). Then, the left end of the shaft 53 is inserted into the shaft engagement portion 72 of the left arm portion 71 and the right end of the shaft 53 is inserted into the shaft engagement portion 72 of the right arm portion 71 (refer to FIG. 5D). The restricted member 52 is thus fixed to the pressing plate 51 in four places such as a front right portion, a front left portion, a rear right portion, and a rear left portion of the restricted member 52. Therefore, the pressing plate 51 moves together with the restricted member 52 without rotating or moving independently with respect to the restricted member 52.

Figure 3:
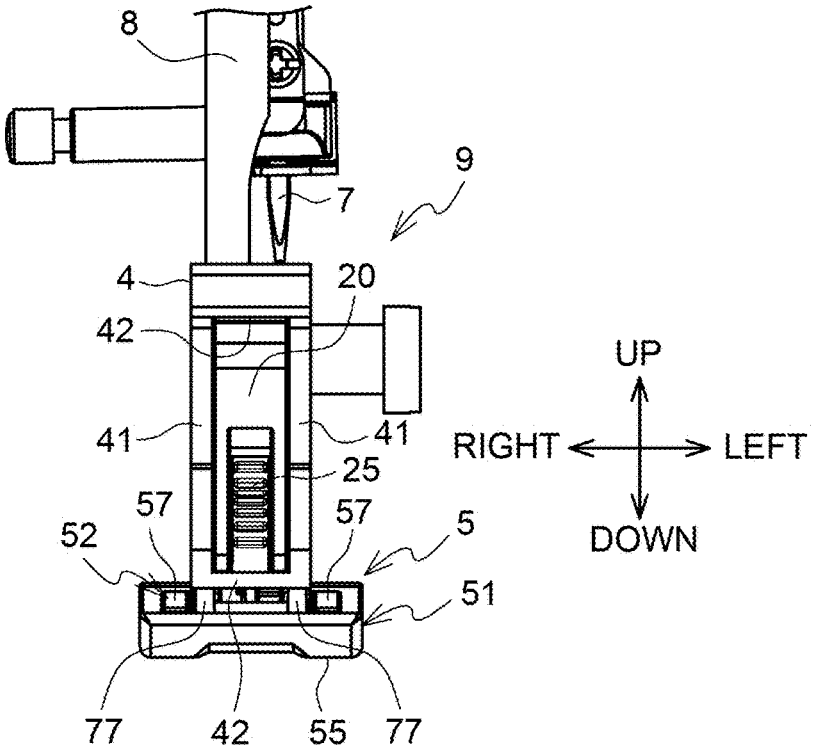
FIG. 3 is a rear view of the presser foot position retainer attached to the lower end portion of the presser bar via the presser holder.

As illustrated in FIG. 2, the restricting member 4 includes a pair of wall portions 41 and a pair of connecting portions 42. The restricting member 4 has a rectangular frame shape in rear view. As illustrated in FIG. 3, the restricting member 4 has the dimension in the left-right direction less than the dimension of the presser foot 5 in the left-right direction. The restricting member has a dimension in the up-down direction greater than the dimension of the restricting member 4 in the left-right direction. Each wall portion 41 has a plate-like shape extending in the up-down direction. The wall portions 41 are spaced from each other in the axial direction J. Each wall portion 41 has a hole 48 (only one of the holes 48 are illustrated in FIG. 6A) extending therethrough in the left-right direction. Each connecting portion 42 has a plate-like shape extending in the up-down direction. The connecting portions 42 are spaced from each other in the up-down direction. The upper connecting portion 42 connects between an upper end portion of the left wall portion 41 and an upper end portion of the right wall portion 41 in the axial direction J. The lower connecting portion 42 connects between a lower end portion of the left wall portion 41 and a lower end portion of the right wall portion 41 in the axial direction J.

The restricting member 4 is attached to the restricting member attaching portion 22 of the presser holder 20 while the presser holder 20 is positioned between the wall portions 41 in the axial direction J and between the connecting portions 42 in the up-down direction. The restricting member 4 is detachably attached to the presser holder 20 by a pin 28 that is inserted through the hole 21 (refer to FIG. 6A) of the presser holder 20 and the holes 48 of the wall portions 41. The restricting member 4 is rotatable about the pin 28. The pin 28 extends parallel to the shaft 53.

The restricting member 4 includes a pair of restricting portions 45 corresponding to the pair of restricted portions 73. The restricting portions 45 are spaced from each other in the axial direction J. Each restricting portion 45 has a second protruding portion 46. The second protruding portions 46 are located above the pressing surface 55 of the presser foot 5 and extend upward. Each restricting portion 45 has a hook-like shape in right side view. The restricting member 4 includes an operation portion 43 opposite to the pair of restricting portions 45 with respect to the pin 28, that is, on an upper side thereof. The operation portion 43 extends in a direction away from the pin 28. The operation portion 43 is disposed at an upper end portion of the restricting member 4. The operation portion 43 is spaced from the presser bar 8 in the front-rear direction. Each wall portion 41 includes a projecting portion 47 facing a corresponding second protruding portion 46. A distance between each of the second protruding portions 46 and its corresponding the projecting portion 47 in the up-down direction is greater than a dimension of the contact portion 74 of the restricted member 52 in the up-down direction.

The operation portion 43 enables the user to change a position of the restricting member 4 between a first position and a second position using n operating member such as a finger of the user. That is, the restricting member 4 is movable between the first position (refer to FIG. 7A) and the second position (refer to FIG. 7B) by a user operation. In a state where the presser foot position retainer 9 is attached to the sewing machine 1 and the restricting member 4 is located at the first position, the restricting portions 45 are spaced from the respective restricted portions 73. Thus, the presser foot 5 is swingable about the shaft 53. An inclination of the presser foot 5 with respect to the needle plate 3 when the restricting member 4 is located at the first position during sewing is defined by the needle plate 3 and a workpiece C with which the pressing surface 55 is in contact.

For example, as illustrated in FIG. 8A, in a case where stitches are formed on the workpiece C in a direction E from a rear edge of the workpiece C in a state where the restricting member 4 is located at the first position, the pressing surface 55 of the presser foot 5 is inclined upward toward the front with respect to the needle plate 3 by swinging of the presser foot 5 about the shaft 53. As illustrated in FIG. 9A, in a case where stitches are formed on the workpiece C along a right edge of the workpiece C in a state where the restricting member 4 is located at the first position, the presser foot 5 is inclined together with the shaft 53. Thus, the pressing surface 55 of the presser foot 5 is inclined downward toward the right with respect to the needle plate 3.

In a state where the presser foot position retainer 9 is attached to the sewing machine 1 and the restricting member 4 is located at the second position, the restricting portions 45 are in contact with the respective restricted portions 73, thereby limiting a swingable range within which the presser foot 5 attached to the presser holder 20 is swingable about the shaft 53 to less than that when the restricting member 4 is located at the first position. An inclination of the presser foot 5 with respect to the needle plate 3 when the restricting member 4 is located at the second position during sewing is defined by the restricting portions 45 being in contact with the respective restricted portions 73.

More specifically, in a state where the presser foot position retainer 9 is attached to the sewing machine 1 and the restricting member 4 is located at the second position, the restricting portions 45 are in contact with the respective restricted portions 73, thereby restricting the restricted portions 73 from swinging in a downward direction from the shaft 53 toward the pressing surface 55. For example, the restricting portions 45 are in contact with the respective restricted portions 73 from below. In a state where the presser foot position retainer 9 is attached to the sewing machine 1 and the restricting member 4 is located at the second position, the contact portions 74 are in contact with the respective corresponding restricting portions 45. In a state where the presser foot position retainer 9 is attached to the sewing machine 1 and the restricting member 4 is located at the second position, the first protruding portions 75 of the restricted portions 73 are in engagement with the second protruding portions 46 of the restricting portions 45, respectively. In a state where the presser foot position retainer 9 is attached to the sewing machine 1 and the restricting member 4 is located at the second position, the projecting portions 47 are in contact with the respective corresponding contact portions 74, thereby restricting the restricted portions 73 from swinging upward. That is, in the illustrative embodiment, the restricting member 4 restricts the restricted portions 73 from moving in the up-down direction, thereby retaining a position of the presser foot 5 such that the pressing surface 55 of the presser foot 5 extends parallel to the needle plate 3.

As illustrated in FIG. 8B, in a case where stitches are formed on the workpiece C in the direction E from the rear edge of the workpiece C in a state where the restricting member 4 is located at the second position, the presser foot 5 is restricted from swinging about the shaft 53 by the restricting member 4, thereby retaining the position of the presser foot 5 such that the pressing surface 55 extends parallel to the needle plate 3. As illustrated in FIG. 9B, in a case where stitches are formed on the workpiece C along the right edge of the workpiece C in a state where the restricting member 4 is located at the second position, the presser foot 5 is restricted from being inclined together with the shaft 53 by the restricting member 4, thereby retaining the position of the presser foot 5 such that the pressing surface 55 extends parallel to the needle plate 3.

Referring to FIG. 10, a description will be provided on a presser foot position retainer 90 according to a first modification. In FIG. 10, common elements have the same reference numerals as those of the presser foot position retainer 9, and a detailed description of the common elements will be omitted. The presser foot position retainer 90 includes a presser foot 5 and a restricting member 103. The restricting member 103 has an inverted U-shape in rear view. More specifically, the restricting member 103 does not include the lower connecting portion 42 that the restricting member 4 according to the illustrative embodiment includes. The other configuration of the restricting member 103 is the same as or similar to that of the restricting member 4.

Referring to FIGS. 11 to 13C, a description will be provided on a presser holder 30 and a presser foot position retainer 91 according to a second modification. In FIGS. 11 to 13, common elements have the same reference numerals as those of the presser foot position retainer 9, and a detailed description of the common elements will be omitted. The presser holder 30 includes a presser bar attaching portion 23, a restricting member attaching portion 31, a presser foot attaching portion 24. The restricting member attaching portion 31 is located behind the presser bar 8. The restricting member attaching portion 31 includes outer peripheral surfaces of a rear portion of the presser holder 30. The restricting member attaching portion 31 has a left surface and a right surface each having a hole 21. Each of the left surface and the right surface has an engagement portion 121, an engagement portion 122, and an engagement portion 123 located in front of a corresponding hole 21. The engagement portions 121, 122, and 123 defined in the left surface of the restricting member attaching portion 31 may be recesses recessed toward the right. The engagement portions 121, 122, and 123 defined in the right surface of the restricting member attaching portion 31 may be recesses recessed toward the left.

The presser foot position retainer 91 includes a presser foot 5 and a restricting member 104. The restricting member 104 has an inverted U-shape in rear view. More specifically, the restricting member 104 does not include the lower connecting portion 42 that the restricting member 4 according to the illustrative embodiment includes. The other configuration of the restricting member 104 is the same as or similar to that of the restricting member 4. The restricting member 104 has wall portions 41 each having a hole 48. Each wall portion 41 includes a positioning portion 111 located in front of the hole 48, which is a point different from the restricting member 4 of the illustrative embodiment. Each positioning portion 111 protrudes toward the front. The left positioning portion 111 includes a pin 112 protruding toward the right from a right surface thereof. The right positioning portion 111 includes a pin 112 protruding toward the left from a left surface thereof. Each pin 112 is disengageably engageable with one of the engagement portions 121 to 123, selectively, of a corresponding surface of the restricting member attaching portion 31. As illustrated in FIG. 12, in a state where each pin 112 is engaged with one of the engagement portions 121 to 123 of the corresponding surface of the restricting member attaching portion 31, the restricting member 104 is restricted from rotating about the pin 28. The restricting member 104 further includes a pair of restricting portions 145 alternative to the pair of restricting portions 45. Each restricting portion 145 does not include the projecting portion 47. The other configurations of the restricting member 104 are the same as or similar to those of the restricting member 4 of the illustrative embodiment.

In the presser foot position retainer 91, an operation portion 43 enables the user to change a position of the restricting member 104 among a first position (refer to FIG. 13A), a second position (refer to FIG. 13B), and a third position (refer to FIG. 13C). More specifically, in response to the user operating the operation portion 43 to change the engagement target with which each pin 112 of the positioning portion 111 is engaged from the engagement portion 121 to the engagement portion 122, the position of the restricting member 104 may be changed from a first position (refer to FIG. 13A) to a second position (refer to FIG. 13B). In response to the user operating the operation portion 43 to change the engagement target with which each pin 112 of the positioning portion 111 is engaged from the engagement portion 122 to the engagement portion 123, the position of the restricting member 104 may be changed from the second position (refer to FIG. 13B) to a third position (refer to FIG. 13C).

As illustrated in FIG. 13A, in a state where the presser foot position retainer 91 is attached to the sewing machine 1 and the pins 112 are in engagement with the respective engagement portions 121, the restricting member 104 is located at the first position. In this state, the restricting portions 145 are spaced from the restricted portions 73 of the presser foot 5, respectively. Thus, the presser foot 5 is swingable about the shaft 53.

As illustrated in FIG. 13B, in a state where the pins 112 are in engagement with the respective engagement portions 122, the restricting member 104 is located at the second position. In this state, the restricting portions 145 are in contact with the restricted portions 73 of the presser foot 5, respectively, from below. Thus, the presser foot 5 is restricted from swinging clockwise (in right side view) about the shaft 53. Nevertheless, the presser foot 5 is not restricted from swinging counterclockwise (in right side view) about the shaft 53.

As illustrated in FIG. 13C, in a state where the pins 112 are in engagement with the respective engagement portions 123, the restricting member 104 is located at the third position. In this state, the restricting portions 145 are in contact with the restricted portions 73 of the presser foot 5, respectively, from below. Thus, the presser foot 5 is restricted from swinging clockwise (in right side view) about the shaft 53. In addition, in this state, the contact portions 74 are in contact with the respective corresponding wall portions 41, and thus, the presser foot 5 is restricted from swinging counterclockwise (in right side view) about the shaft 53. In the presser foot position retainer 91 according to the second modification, the swingable range of the presser foot 5 may be changed stepwise.

Referring to FIG. 14, a description will be provided on a presser foot 65 according to a third modification. In FIG. 14, common elements have the same reference numerals as those of the presser foot 5 of the presser foot position retainer 9, and a detailed description of the common elements will be omitted. The presser foot 65 includes a pressing plate 63 and a restricted member 66. The pressing plate 63 has a configuration different from the pressing plate 51 of the illustrative embodiment. More specifically, for example, a left guide support portion 57 of the pressing plate 63 has a threaded hole 158 alternative to the hole 58 and the pressing plate 63 includes a screw-type guide 83 alternative to the rod-like guide 56. The other configurations of the pressing plate 63 are the same as or similar to those of the pressing plate 51 of the illustrative embodiment.

The restricted member 66 has a configuration different from the restricted member 52 of the illustrative embodiment. More specifically, for example, the restricted member 66 has an H shape in plan view, and arm portions 71 each include a shaft engagement portion 79 that may have a cutout having an open end opening toward the bottom alternative to the shaft engagement portion 72 that may have a through hole. The restricted member 66 further includes a pair of guide engagement portions 177 alternative to the pair of guide engagement portions 77. While the guide engagement portions 77 each have a cutout, the guide engagement portions 177 may each have a through hole. The other configurations of the restricted member 66 are the same as or similar to those of the restricted member 52 of the illustrative embodiment. In the presser foot 65 according to the third modification, the shaft engagement portions 79 are engaged with the shaft 53, and then the guide 83 is inserted into the hole 58 of the right guide support portion 57, the through holes of the guide engagement portions 177, and the threaded hole 158 of the left guide support portion 57 from the right to fasten the guide 83 to the threaded hole 158. The restricted member 66 is thus fixed to the pressing plate 63 in four places such as a front right portion, a front left portion, a rear right portion, and a rear left portion of the restricted member 66.

Referring to FIG. 15, a description will be provided on a presser foot 67 according to a fourth modification. In FIG. 15, common elements have the same reference numerals as those of the presser foot 5 of the presser foot position retainer 9 according to the illustrative embodiment or the presser foot 65 according to the third modification, and a detailed description of the common elements will be omitted. The presser foot 67 includes a pressing plate 51 and a restricted member 68. The restricted member 68 has an H shape in plan view, and includes a pair of arm portions 71. Each arm portion 71 includes a shaft engagement portion 79 having a configuration that may be the same as or similar to that of the third modification. The restricted member 68 further includes a pair of guide engagement portions 178 having threaded holes alternative to the pair of guide engagement portions 77 having the cutouts. The presser foot 67 further includes a pair of left and right guides 82 having threaded portions, respectively. The other configurations of the restricted member 68 are the same as or similar to those of the restricted member 52 of the illustrative embodiment. In the presser foot 67 according to the fourth modification, the shaft engagement portions 79 are engaged with the shaft 53, and then the right guide 82 is inserted into the hole 58 of the right guide support portion 57 and screwed into the right guide engagement portion 178. Further, the left guide 82 is inserted into the hole 58 of the left guide support portion 57 and screwed into the left guide engagement portion 178. The restricted member 68 is thus fixed to the pressing plate 51 in four places such as a front right portion, a front left portion, a rear right portion, and a rear left portion of the restricted member 68.

The sewing machine 1 according to the illustrative embodiment includes the needle bar 6, the presser bar 8, the presser holder 20, and the presser foot position retainer 9. The needle bar 6 is configured to support the needle 7. The needle 7 is detachably attachable to the lower end of the needle bar 6. The presser bar 8 extends parallel to the needle bar 6. The presser holder 20 includes the restricting member attaching portion 22 and the presser foot attaching portion 24. The restricting member attaching portion 22 is attached to the lower end of the presser bar 8 such that at least a portion of the restricting member attaching portion 22 is located opposite to the needle bar 6 with respect to the presser bar 8. The restricting member 4 of the presser foot position retainer 9 is attachable to the restricting member attaching portion 22. The presser foot attaching portion 24 is detachably engageable with the shaft 53 of the presser foot 5. The presser foot position retainer 9 includes the presser foot 5 and the restricting member 4. The presser foot 5 is swingably attachable to the presser holder 20 of the sewing machine 1. The presser foot 5 includes the shaft 53 extending in the axial direction J, the restricted portions 73, and the pressing surface 55 that is capable of pressing the workpiece C. The restricting member 4 has the restricting portions 45 that are contactable to the restricted portions 73, respectively. The restricting member 4 is attached to the presser holder 20. The restricting member 4 is movable between the first position and the second position by a user operation. When the restricting member 4 is located at the second position, the restricting portions 45 are in contact with the respective restricted portions 73, thereby limiting the swingable range within which the presser foot 5 attached to the presser holder 20 is swingable about the shaft 53 to less than that when the restricting member 4 is located at the first position. The state of the presser foot position retainer 9 may be changed between a normal state and a restricted state by a user operation of the restricting member 4. When the restricting member 4 is located at the first position, the presser foot position retainer 9 may be in the normal state. When the restricting member 4 is located at the second position, the presser foot position retainer 9 is in the restricted state where the swingable range of the presser foot 5 is less than that when the presser foot position retainer 9 is in the normal state. Therefore, the user of the sewing machine 1 and the presser foot position retainer 9 may change the state of the presser foot position retainer 9 between the normal state and the restricted state at a desired timing.

The restricting member 4 is located behind the presser bar 8. Thus, compared to a case where the restricting member 4 is located in front of, to the right of, or to the left of the presser bar 8 in the presser foot position retainer 9, the restricting member 4 is less likely to interfere with sewing. The restricting member 4 has the dimension in the left-right direction less than the dimension of the presser foot 5 in the left-right direction. Thus, compared to a case where the dimension of the restricting member 4 in the left-right direction is greater than the dimension of the presser foot 5 in the left-right in the presser foot position retainer 9, the restricting member 4 is less likely to interfere with sewing. The position where the restricting portions 45 contact the respective restricted portions 73 in the front-rear direction is further to the rear than the presser bar 8 and relatively far away from the shaft 53 located further to the front than the presser bar 8. Thus, compared to a case where the position where the restricting portions 45 contact the respective restricted portions 73 is relatively close to the shaft 53, the swingable range within which the presser foot 5 is swingable about the shaft 53 may be limited more easily. Each of the shaft engagement portions 72 of the restricted member 52 contacts a corresponding one of the shaft support portions 61 of the pressing plate 51 on a side closer to the center line M than its opposite side to the center line M. Each of the guide engagement portions 77 of the restricted member 52 contacts a corresponding one of the respective guide support portions 57 of the pressing plate 51 on a side farther from the center line M than its opposite side from the center line M. Therefore, the restricted member 52 may be less likely to rattle in the left-right direction with respect to the pressing plate 51 than in a case where the pair of shaft engagement portions 72 and the pair of guide portion engagement portions 77 contact the respective portions of the pressing plate 51 on the same side.

In a state where the presser foot position retainer 9 is attached to the sewing machine 1 and the restricting member 4 is located at the first position, the restricting portions 45 are spaced from the respective restricted portions 73. In a state where the presser foot position retainer 9 is attached to the sewing machine 1 and the restricting member 4 is located at the second position, the restricting portions 45 are in contact with the respective restricted portions 73 from below, thereby restricting the restricted portions 73 from swinging in the downward direction from the shaft 53 toward the pressing surface 55. Therefore, when the restricting member 4 is located at the second position, the restricted portions 73 may be restricted from swinging downward.

Each of the restricted portions 73 has a hook-like shape having the first protruding portion 75 that is located above the pressing surface 55 and extends downward. Each of the restricting portions 45 has a hook-like shape having the second protruding portion 46 that is located above the pressing surface 55 and extends upward. In a state where the presser foot position retainer 9 is attached to the sewing machine 1 and the restricting member 4 is located at the second position, the first protruding portions 75 of the restricted portions 73 are in engagement with the second protruding portions 46 of the restricting portions 45, respectively. This may thus restrict the presser foot 5 from swinging downward about the shaft 53. When the restricting member 4 is located at the first position, the first protruding portions 75 and the second protruding portions 46 are not in engagement with each other. Thus, compared to a case where the first protruding portion 75 and the second protruding portion 46 are in engagement with each other when the restricting member 4 is located at the first position, the presser foot 5 may swing about the shaft 53 with respect to the needle plate 3 easily.

The restricting member 4 is supported by the presser holder 20 via the pin 28. The restricting member 4 is movable between the first position and the second position by rotating about the pin 28. The position of the restricting member 4 may be changed by the user with a simple operation of rotating the restricting member 4 about the pin 28.

According to the illustrative embodiment, the pin 28 extends parallel to the shaft 53. If the pin 28 extends in a direction intersecting the shaft 53, when the restricting member 4 is located at the first position, the restricting member 4 protrudes from the presser foot 5 in the axial direction J. Therefore, the protruding restricting member 4 may interfere with sewing. According to the illustrative embodiment, such a pin arrangement may reduce the possibility that the restricting member 4 interferes with the sewing regardless of the position of the restricting member 4, compared to a case where the pin 28 extends in the direction intersecting the shaft 53.

Each restricting portion 45 includes the projecting portion 47 that is contactable with a corresponding restricted portion 73 from above in a state where the presser foot position retainer 9 is attached to the sewing machine 1 and the restricting member 4 is located at the second position. With this configuration, when the restricting member 4 is located at the second position, the restricted portions 73 may be restricted from swinging upward by the respective projecting portions 47.

The restricting member 4 includes the operation portion 43 opposite to the pair of restricting portions 45 with respect to the pin 28. The operation portion 43 extends in the direction away from the pin 28. The operation portion 43 may be operated by the user. The position of the restricting member 4 may be changed between the first position and the second position by user operation of the operation portion 43. Compared to a case where the restricting member 4 is not provided with the operation portion 43, such a configuration may enable the user to change the position of the restricting member 4 more readily. The operation portion 43 is disposed opposite to the pair of restricting portions 45 with respect to the pin 28. Such a configuration may thus enable the user to change the position of the restricting member 4 with a relatively small force. The operation portion 43 is located far from the workpiece C than the pin 28 from the workpiece C. Thus, compared to a case where the operation portion 43 is located closer to the workpiece C than the pin 28 to the workpiece C, such a configuration may enable the user to access to the operation portion 43 readily with an operating body such as a finger of the user and to switch the position of the restricting member 4 readily.

The restricted portions 73 include the contact portions 74, respectively, that extend parallel to the pressing surface 55 and are in contact with the respective corresponding restricting portions 45 in a state where the presser foot position retainer 9 is attached to the sewing machine 1 and the restricting member 4 is located at the second position. With this configuration, in a state where the restricting member 4 is located at the second position, the restricting portions 45 and the restricted portions 73 are in contact with each other, thereby more securely restricting the presser foot 5 from swinging about the shaft 53.

The presser foot 5 includes the pair of restricted portions 73. The restricted portions 73 are spaced from each other in the axial direction J. The restricting member 4 includes the pair of restricting portions 45 corresponding to the pair of restricted portions 73. The restricting portions 45 are spaced from each other in the axial direction J. The restricting member 4 is movable between the first position and the second position by a user operation. When the restricting member 4 is located at the second position, the restricting portions 45 are in contact with the respective restricted portions 73, thereby limiting the swingable range within which the presser foot 5 attached to the presser holder 20 is swingable to less than that when the restricting member 4 is located at the first position. Compared to a case where the presser foot position retainer 9 includes a single restricting portion 45 and a single restricted portion 73 corresponding to the restricting portion 45, such a configuration may restrict the presser foot 5 from tilting with respect to the axial direction J in a state where the presser foot position retainer 9 is attached to the presser holder 20 of the sewing machine 1 and the restricting member 4 is located at the second position.

The restricting member 4 includes the pair of wall portions 41 and the pair of connecting portions 42. The connecting portions 42 are spaced from each other in the up-down direction. Each connecting portion 42 connects between the wall portions 41 in the axial direction J. The restricting member 4 is attached to the presser holder 20 while the presser holder 20 is positioned between the wall portions 41 in the axial direction J and between the connecting portions 42 in the up-down direction. With this configuration, compared to a case where the restricting member 4 has a single wall portion 41, the restricting member 4 may be stably attached to the presser holder 20. In addition, compared to a case where the restricting member 4 is provided with a single connecting portion 42, the wall portions 41 may be stably connected to each other. Even in a state where the restricting member 4 is attached to the presser holder 20, the user may be enabled to operate the lever 25 of the presser holder 20.

The presser foot 5 includes the pressing plate 51 having the pressing surface 55, and the restricted member 52 having the restricted portions 73 and detachably attachable to the pressing plate 51. Compared to a case where the pressing plate 51 and the restricted member 52 are inseparable from each other, such a configuration may increase flexibility in designing the presser foot 5. In a case where various types of pressing plates 51 are provided, a restricted member 52 common to the various types of pressing plates 51 may be used. Use of the common restricted member 52 may enable all of the various types of pressing plates 51 to be used in the sewing machine 1. The pressing plate 51 may be made of material different from the material used for the restricted member 52. In one example, the pressing plate 51 may be made of metal and the restricted member 52 may be made of resin. With this configuration, when the restricted portions 73 are worn due to use, the restricted member 52 may be replaced with a new restricted member 52.

The presser foot 5 includes the pressing plate 51 and the restricted member 52. The presser foot 5 has the pressing surface 55, the shaft 53, and the guide 56 spaced from the shaft 53 in the longitudinal direction of the presser foot 5. The restricted member 52 is detachably attached to the pressing plate 51. The restricted member 52 includes the pair of shaft engagement portions 72 and the pair of guide engagement portions 77. The shaft engagement portions 72 are spaced from each other in the axial direction J and disengageably engaged with the shaft 53. The guide engagement portions 77 are spaced from each other in the axial direction J and disengageably engaged with the guide 56. Thus, the restricted member 52 may be stably attached to the pressing plate 51 by the pair of shaft engagement portions 72 and the pair of guide engagement portions 77 in four places.

The guide 56 has a rod-like shape, and each of the guide engagement portions 77 may have a cutout. Engagement of the pair of guide engagement portions 77 with the guide 56 via the cutouts enables the restricted member 52 to be attached to the pressing plate 51. As described above, such a relatively simple configuration may enable the restricted member 52 to be stably attached to the pressing plate 51 in four places.

The restricting member 4 is detachably attachable to the presser holder 20 by the pin 28 inserted through the hole 21 of the presser holder 20. With this configuration, in a case where the restricting member 4 is not needed for sewing, the restricting member 4 is removed from the presser holder 20 to secure high visibility during sewing. In a case where the restricting member 4 is needed for sewing, the restricting member 4 is attached to the presser holder 20. Thus, compared to a case where the restricting member 4 is inseparable from the presser holder 20, user convenience may be improved. Further, the restricting member 4 may be detachably attached to the presser holder 20 with a relatively simple configuration.

The restricting member 103 according to the first modification includes the pair of wall portions 41 and the connecting portion 42 that connects between the wall portions 41 in the axial direction J. The restricting member 103 is attached to the presser holder 20 while the presser holder 20 is positioned between the wall portions 41 in the axial direction J. With this configuration, compared to a case where the restricting member 103 has a single wall portion 41, the restricting member 4 may be stably attached to the presser holder 20. In a case where the restricting member 103 is attached to the presser holder 20, also, the user may be enabled to access and operate the lever 25 of the presser holder 20. The presser foot position retainer 91 according to the second modification may also achieve the same effects as those achieved by the presser foot position retainer 90 according to the first modification.

According to the fourth modification, each guide 82 is a screw-type guide having a threaded portion and each guide engagement portion 178 is a threaded hole into which the screw-type guide 82 is screwed. Engagement of the threaded portions of the guides 82 with the threaded holes of the guide engagement portions 178, respectively, enables the restricted member 68 to be attached to the pressing plate 51. In a case where the presser foot position retainer 9 includes the presser foot 67 according to the fourth modification alternative to the presser foot 5, the restricted member 68 may also be stably attached to the pressing plate 51 in four places with a relatively simple configuration.

The restricting member 104 according to the second modification includes the positioning portions 111. When the restricting member 104 is located at the first position, the pins 112 of the positioning portions 111 are in engagement with the engagement portions 121, respectively, of the presser holder 20. When the restricting member 104 is located at the second position, the pins 112 of the positioning portions 111 are in engagement with the engagement portions 122, respectively, of the presser holder 20. The restricting member 104 according to the second modification may change the state of the presser foot position retainer 91 between the normal state and the restricted state with a simple user operation of changing to other engagement portions from the engagement portions with which the pins 112 of the positioning portions 111 are currently in engagement. As described above, in the presser foot position retainer 91 according to the second modification, the swingable range of the presser foot 5 may be changed stepwise.

While the disclosure has been described in detail with reference to the specific embodiment thereof, this is merely an example, and various changes, arrangements and modifications may be made therein without departing from the spirit and scope of the disclosure.

The sewing machine 1 and the presser foot position retainer 9 may have other configurations, respectively. For example, the sewing machine 1 may be an industrial sewing machine. The presser holders 20 and 30 of the sewing machine 1 may have other configurations, respectively. In a state where the presser foot position retainer 9 is attached to the sewing machine 1 and the restricting member 4 is located at the first position, the restricting portions 45 may be in contact with the respective restricted portions 73. In one example, the second position according to the second modification may be defined as the first position and the third position according to the second modification may be defined as the second position. In this way, the swingable range of the presser foot 5 when the restricting member 104 is located at the second position may be less than that when the restricting member 104 is located at the first position.

The shape, size, number, and arrangement of the restricted portions 73 may be changed as appropriate. The restricted portions 73 might not necessarily include the first protruding portions 75, respectively. Alternatively, the restricted portions 73 may include recesses, respectively, recessed upward instead of the first protruding portions 75. In this case, in a state where the presser foot position retainer 9 is attached to the sewing machine 1 and the restricting member 4 is located at the second position, the second protruding portions 46 of the restricting portions 45 may be in engagement with the recesses of the restricted portions 73, respectively.

The restricting member 4 may be supported by the presser holder 20 in another manner. In one example, the wall portions 41 of the restricting member 4 may include pins, respectively, protruding toward each other. The restricting member 4 may be supported by the presser holder 20 by engagement of the pins with the respective holes 21. In another example, the presser holder 20 may include pins each protruding away from each other. Further, the wall portions 41 of the restricting member 4 may have engagement portions into which the pins of the presser holder 20 are inserted respectively. The engagement portions may be recesses recessed in the axial direction J or may be through holes extending through the respective wall portions 41 in the axial direction J. The pins may extend in a direction intersecting the shaft 53. The restricting member 4 might not necessarily include the operation portion 43. The shape and arrangement of the operation portion 43 may be changed as appropriate. The shape of the restricting member 4 may be changed as appropriate in accordance with the shape of the presser holder 20, the manner that the presser holder 20 supports the restricting member 4, or both. In one example, the rear portion of the presser holder 20 may have a frame-like shape in a rear view. In this case, the restricting member 4 may have a rectangular shape in a rear view to be engaged with the rear portion of the frame-shaped presser holder 20. The restricting member 4 may include either of the wall portions 41. The number of the connecting portions 42, the position of the connecting portions 42 in the up-down direction, or both may be changed as appropriate.

The restricted portions 73 might not necessarily include the contact portions 74, respectively, extending parallel to the pressing surface 55. The presser foot 5 may include the pressing plate 51 and the restricted member 52 that may be integral with each other. In this case, the pressing plate 51 may have the pressing surface 55, and the restricted member 52 may have the restricted portions 73 and may be detachably attachable to the pressing plate 51. In a case where the presser foot 5 includes the pressing plate 51 and the restricted member 52, a manner of attaching the restricted member 52 to the pressing plate 51 may be changed as appropriate. In one example, the restricted member 52 may have a V shape in which an acute angle may be pointed toward the front in plan view. In this case, the restricted member 52 may be fixed to the pressing plate 51 in three places such as a front center portion, a rear right portion, and a rear left portion of the restricted member 52. In another example, the restricted member 52 may have a rectangular shape or a polygonal shape in plan view. A range in which the pair of shaft engagement portions 72, the pair of guide engagement portions 77, and the pair of restricted portions 73 each extend in the axial direction J may be changed as appropriate in accordance with the configuration of the restricted member 52. The shape, number, and arrangement of the shaft engagement portions 72 may be changed as appropriate in accordance with the configuration of the shaft 53. The shape, number, and arrangement of the guide engagement portions 77 may be changed as appropriate in accordance with the configuration of the guide 56. In one example, the shaft engagement portions 72 are not limited to the through holes but may be recesses, cutouts, or others as long as the shaft engagement portions 72 can be engaged with the shaft 53.

In a case where the restricting member 104 includes the positioning portions 111 as in the second modification, the positioning portions 111 may be changed as appropriate in accordance with the configurations of the first engagement portion and the second engagement portion. In a case where the first engagement portion and the second engagement portion are protrusions, the positioning portions 111 may be recesses that may be engageable with the protrusions, respectively. The sewing machine 1 may have indications such as numbers, characters, letters, or figures indicating the position of the restricting member 104 at positions where the user can easily recognize the indications, for example, a left surface of the presser foot position retainer 91 and a left surface of the presser holder 30.

The restricting member 4 may have any configuration as long as the position of the restricting member 4 may be changed between multiple positions including the first position and the second position. The restricting member 4 may be movable between the first position and the second position by sliding linearly or curvedly along a guide such as a groove provided in the presser holder 20. The above-described modification examples may be appropriately combined within a range in which there is no contradiction.

What is claimed is:

1. A presser foot position retainer, comprising:

a presser foot swingably attachable to a presser holder of a sewing machine, the presser foot including a shaft extending in an axial direction, a restricted portion, and a pressing surface configured to press a workpiece; and a restricting member including a restricting portion capable of contacting the restricted portion, the restricting member being attachable to the presser holder, wherein the restricting member is configured to move between a first position and a second position by a user operation, wherein when the restricting member is located at the second position, the restricting portion is in contact with the restricted portion to limit a swingable range within which the presser foot attached to the presser holder is swingable about the shaft to less than that when the restricting member is located at the first position.

2. The presser foot position retainer according to claim 1, wherein when the presser foot position retainer is attached to the sewing machine and the restricting member is located at the second position, the restricting portion and the restricted portion are in contact with each other to restrict a swinging of the restricted portion in a first direction from the shaft toward the pressing surface.

3. The presser foot position retainer according to claim 2, wherein when the presser foot position retainer is attached to the sewing machine and the restricting member is located at the first position, the restricting portion and the restricted portion are spaced from each other.

4. The presser foot position retainer according to claim 2, wherein the restricted portion has a hook shape, wherein the restricting portion has a hook shape, and wherein when the presser foot position retainer is attached to the sewing machine and the restricting member is located at the second position, the restricted portion and the restricting portion are in engagement with each other.

5. The presser foot position retainer according to claim 4, wherein when the presser foot position retainer is attached to the sewing machine and the restricting member is located at the first position, the restricting portion and the restricted portion are not in engagement with each other.

6. The presser foot position retainer according to claim 1, wherein the restricting member is supported by the presser holder via a pin, and is movable between the first position and the second position by rotating about the pin.

7. The presser foot position retainer according to claim 6, wherein the pin extends parallel to the shaft.

8. The presser foot position retainer according to claim 2, wherein the restricting member further includes a projecting portion contactable to the restricted portion when the presser foot position retainer is attached to the sewing machine and the restricting member is located at the second position, and wherein when the projecting portion is in contact with the restricted portion, the restricting portion restricts a swinging of the restricting portion in a second direction opposite to the first direction.

9. The presser foot position retainer according to claim 6, wherein the restricting member includes an operation portion being disposed opposite to the restricting portion with respect to the pin, the operation portion being operable by a user to move the restricting member between the first position and the second position.

10. The presser foot position retainer according to claim 1, wherein the restricted portion includes a contact portion extending parallel to the pressing surface, the contact portion being in contact with the restricting portion when the presser foot position retainer is attached to the sewing machine and the restricting member is located at the second position.

11. The presser foot position retainer according to claim 1, wherein the presser foot includes a pair of the regulated portions spaced apart from each other in the axial direction, wherein the restricting member includes a pair of the restricting portions spaced apart from each other in the axial direction and corresponding to the pair of the regulated portions, and wherein when the restricting member is located at the second position, the restricting portions are in contact with the restricted portions, respectively, to limit the swingable range within which the presser foot attached to the presser holder is swingable about the shaft to less than that when the restricting member is located at the first position.

12. The presser foot position retainer according to claim 1, wherein the restricting member further includes:

a pair of wall portions; and a connecting portion connecting the wall positions to each other in the axial direction, and wherein the restricting member is attached to the presser holder while the presser holder is positioned between the wall portions in the axial direction.

13. The presser foot position retainer according to claim 2, wherein the restricting member further includes:

a pair of wall portions; and a pair of connecting portions spaced from each other in a third direction including the first direction and the second direction, the pair of connecting portions connecting the wall positions to each other in the axial direction, and wherein the restricting member is attached to the presser holder while the presser holder is positioned between the wall portions in the axial direction and between the connecting portions in the third direction.

14. The presser foot position retainer according to claim 1, wherein the presser foot includes:

a pressing plate having the pressing surface; and a restricted member including the restricted portion and detachably attachable to the pressing plate.

15. The presser foot position retainer according to claim 1, wherein the presser foot includes:

a pressing plate including the pressing surface, the shaft, and a guide spaced apart from the shaft in a longitudinal direction of the presser foot; and a restricted member detachably attachable to the pressing plate, the restricted member including:

a pair of shaft engagement portions disengageably engageable with the shaft, the shaft engagement portions being spaced apart from each other in the axial direction; and a pair of guide engagement portions disengageably engageable with the shaft, the guide engagement portions being spaced apart from each other in the axial direction.

16. The presser foot position retainer according to claim 15, wherein the guide has a rod-like shape, wherein each of the pair of guide engagement portions has a cutout, and wherein engagement of the pair of guide engagement portions with the guide via the cutouts enables the restricted member to be attached to the pressing plate.

17. The presser foot position retainer according to claim 15, wherein the guide has a threaded portion, wherein at least one of the pair of guide engagement portions has a threaded hole into which the threaded portion of the guide is screwed, and wherein engagement of the threaded portion of the guide with the threaded hole of the at least one of the pair of guide portion engagement portions enables the restricted member to be attached to the pressing plate.

18. The presser foot position retainer according to claim 6, wherein the presser holder has a hole, and wherein the restricting member is detachably attached to the presser holder by the pin inserted through the hole of the presser holder.

19. The presser foot position retainer according to claim 1, wherein the restricting member includes a positioning portion, and wherein when the restricting member is located at the first position, the positioning portion is in engagement with a first engagement portion of the presser holder, and when the restricting member is located at the second position, the positioning portion is in engagement with a second engagement portion of the presser holder.

20. A sewing machine, comprising:

the presser foot position retainer according to claim 1;

a needle bar having a lower end to which a needle is attachable;

a presser bar extending parallel to the needle bar; and a presser holder including:

a restricting member attaching portion attached to a lower end of the presser bar such that at least a portion of the restricting member is located opposite to the needle bar with respect to the presser bar, the restricting member attaching portion to which the restricting member of the presser foot position retainer is attachable; and a presser foot attaching portion with which the shaft of the presser foot is detachably engageable.

* * * * *